US005715891A

United States Patent [19]

Graham

[11] Patent Number: 5,715,891

[45] Date of Patent: Feb. 10, 1998

[54] METHOD FOR ISOLATING MULTI-LATERAL WELL COMPLETIONS WHILE MAINTAINING SELECTIVE DRAINHOLE RE-ENTRY ACCESS

[75] Inventor: Stephen A. Graham, Bellaire, Tex.

[73] Assignee: Natural Reserves Group, Inc., Houston, Tex.

[21] Appl. No.: 534,695

[22] Filed: Sep. 27, 1995

[51] Int. Cl.[6] ..... E21B 7/08; E21B 23/14

[52] U.S. Cl. ..... 166/313; 166/50; 166/117.6

[58] Field of Search ..... 166/50, 313, 117.6

[56] References Cited

U.S. PATENT DOCUMENTS

| | | | |
|---|---|---|---|
| 2,397,070 | 3/1946 | Zublin | 166/4 |
| 2,452,920 | 11/1948 | Gilbert | 255/1.6 |
| 2,797,893 | 7/1957 | McCune | 166/50 X |
| 2,858,107 | 10/1958 | Colmeraver | 255/1.6 |
| 3,330,349 | 7/1967 | Owsley et al. | 166/21 |
| 3,887,021 | 6/1975 | Elbert | 175/422 |
| 3,908,759 | 9/1975 | Caele et al. | 166/117.6 |
| 4,396,075 | 8/1983 | Wood et al. | 175/79 |
| 4,402,551 | 9/1983 | Wood et al. | 299/5 |
| 4,415,205 | 11/1983 | Rehm et al. | 299/5 |
| 4,444,276 | 4/1984 | Peterson, Jr. | 175/61 |
| 4,573,541 | 3/1986 | Josse et al. | 175/78 |
| 4,714,117 | 12/1987 | Dech | 166/380 |
| 4,742,871 | 5/1988 | Miffre | 166/117.5 |
| 4,800,966 | 1/1989 | Parant et al. | 175/73 |
| 4,807,704 | 2/1989 | Hsu et al. | 166/313 |
| 4,869,323 | 9/1989 | Stagg | 166/285 |
| 4,880,059 | 11/1989 | Brandell et al. | 166/332 |
| 4,915,172 | 4/1990 | Donovan et al. | 166/278 |
| 4,928,763 | 5/1990 | Falk | 166/250 |
| 4,949,788 | 8/1990 | Searka et al. | 166/285 |
| 5,040,601 | 8/1991 | Karlsson et al. | 166/278 |
| 5,113,938 | 5/1992 | Clayton | 166/117.6 |
| 5,289,876 | 3/1994 | Graham | 166/276 |
| 5,301,760 | 4/1994 | Graham | 175/61 |
| 5,311,936 | 5/1994 | McNair et al. | 166/50 |
| 5,318,121 | 6/1994 | Brackman et al. | 166/313 |
| 5,318,122 | 6/1994 | Murray et al. | 166/313 |
| 5,322,127 | 6/1994 | McNair et al. | 166/313 |
| 5,325,924 | 7/1994 | Bangert et al. | 166/313 |
| 5,330,007 | 7/1994 | Collins et al. | 166/313 |
| 5,337,808 | 8/1994 | Graham | 166/191 |
| 5,353,876 | 10/1994 | Curington et al. | 166/313 |
| 5,375,661 | 12/1994 | Daneshy et al. | 166/278 |
| 5,388,648 | 2/1995 | Jordan et al. | 166/380 |
| 5,398,754 | 3/1995 | Dinhoble | 166/117.6 |
| 5,411,082 | 5/1995 | Kennedy | 166/181 |
| 5,423,387 | 6/1995 | Lynde | 175/61 |
| 5,427,177 | 6/1995 | Jordan et al. | 166/50 |
| 5,462,120 | 10/1995 | Gondouin | 166/117.6 X |

*Primary Examiner*—Hoang C. Dang
*Attorney, Agent, or Firm*—Kurt S. Myers

[57] ABSTRACT

In a cased wellbore having one or more cased and cemented drainholes extending therefrom such that the elliptical shaped opening or junction of each drainhole with the primary well is sealed and cut flush with the inside of the primary well casing, an inventive method is disclosed for: (a) isolating each perforated and/or drainhole completion within the primary wellbore, (b) providing flow control means for each completion to permit selective testing, stimulation, production, or abandonment, and (c) facilitating selective re-entry into any cased drainhole for conducting additional drilling, completion, or remedial work. In a preferred embodiment, a production liner is permanently attached within the primary well casing such that packers straddle permanent flow control devices and precut liner windows which are positioned adjacent to perforated completions and drainhole entrance openings, respectively. Orientation key slots built into internal seal bore/latch down profile collars positioned below each precut window are used in conjunction with a novel wireline conveyed video camera tool to properly align the base of each precut liner window to the bottom of each elliptical shaped drainhole opening.

38 Claims, 14 Drawing Sheets

10
98
68
18
194
196
198
168
182
178
186
192
190
180
176
24
174
46
172
166
184
188
170

10
68
98
18
168
186
178
46
100
106
105
24
64
104
200
174
202
166
176

10
68
18
168
182
178
24
190
174
166
184
150
170
188

10
186
178
204
24
206
192
184

10
68
18
160
158
152
178
156
166
184
172
170
154
48

10
98
68
18
70
72
96
94
92
86
66
60
100
84
106
105
24
46
90
64
104
102
82
88
26
78
74
80
76

18
10
72
96
92
86
84
94
24
66
88
90
82
26
78
76

10
108
68
66
128
84
138
140
144
148
24
46
142
136
134
126
132
90
130
146

10
108
66
144
138
24
142
126
134
130
146
150

68
108
10
160
152
158
156
138
126
142
132
130
154
66
48

10
120
164
112
22
118
92
162
84
24
90
74
78
26

METHOD FOR ISOLATING MULTI-LATERAL WELL COMPLETIONS WHILE MAINTAINING SELECTIVE DRAINHOLE RE-ENTRY ACCESS

CROSS-REFERENCE TO RELATED APPLICATION

This application is related to the U.S. patent application Ser. No. 08/534,701 entitled "Method and Apparatus for Selective Horizontal Well Re-entry using Retrievable Diverter Oriented by Logging Means" invented by Stephen A. Graham which has been filed on Sep. 27, 1995 contemporaneously herewith.

FIELD OF THE INVENTION

The present invention relates to novel methods and devices for simultaneously completing hydrocarbon productive zone(s) from a cased vertical well containing one or more horizontal drainholes extending from the vertical well together with completions made directly from the vertical well (ie: perforated casing). The resulting well configuration provides pressure isolation and selective flow control between each drainhole and/or vertical well completion and provides convenient access to the drainhole(s) for re-entry at any time during the productive life cycle of the vertical well. In situations where completion isolation and selective flow control are not necessary, new and improved methods and devices are presented to facilitate selective re-entry into any drainhole using routine workover means and without any reduction in the inside diameter of the vertical well casing subsequent to re-entry operations. Other important features of this novel multi-lateral completion system are described herein.

BACKGROUND OF THE INVENTION

It is not uncommon for a vertical well to encounter a plurality of hydrocarbon bearing formations with varying degrees of potential productivity. Due to differences in reservoir pressure, fluid content, and petrophysical properties, downhole commingling of production from multiple zones if often not only detrimental to the ultimate recovery of the well, but prohibited by government regulatory agencies.

A number of different completion methods have been used to independently produce multiple zones encountered in a single well. In the simplest of these completion techniques, the lowermost productive zone is perforated and produced until the hydrocarbon production rate becomes economically marginal. Then, the zone is abandoned and the well is recompleted to the next shallower zone. Upon depletion of this zone, the well is again recompleted to the next shallower zone. Upon depletion of this zone, the well is again recompleted and produced until all potential zones have been produced. Upon depletion of the shallowest productive zone, the well is plugged and abandoned. A graph showing hydrocarbon production rate versus time for such a well would typically exhibit a "roller coaster" profile with relatively high production rates occurring immediately after each new zone completion.

In an effort to prolong a well's flush production period and smooth out this "roller coaster" production profile, more complex completion methods are employed. One such technique involves using multiple strings of production tubing with specially spaced multiple completion packers for isolating each completed zone. An important drawback to this type completion design is the size of independent production strings make it difficult to artificially lift the produced fluids from each zone should the well cease to flow naturally.

Multi-zone techniques facilitating the independent completion of one or more horizontal drainholes extending from a vertical well together with one or more "conventional" vertical well completions have become important to the oil industry in recent years. Such wells are commonly referred to as multi-lateral wells. Horizontal drainhole completions typically exhibit substantially better productivity than vertical well completions, but due to the increased well cost coupled with the requirement of excellent subsurface geologic definition, are not appropriate in all cases. Horizontally drilled wells, or wells which have nearly horizontal sections, are now used routinely to exploit productive formations in a number of development situations. Horizontal drainholes are often used to efficiently exploit vertically fractured formations, thin reservoirs having matrix porosity, formations prone to coning water, steam, or gas due to "radial flow" characteristics inherent in vertical well completions, and formations undergoing enhanced oil recovery operations. Drilling horizontal wells also has application in offshore development where fewer and smaller platforms are required due to the increased productivity of horizontal drainholes compared to vertical completions and the possibility of drilling multiple drainholes from one vertical well platform slot. Drilling multiple drainholes from a new or existing cased vertical well with completions in the same formation or in different formations enables both the productivity and return-on-investment in equipment infrastructure of the vertical well to be maximized.

The majority of multi-lateral wells drilled today are rather simply completed in the sense that the horizontal drainholes commingle well fluids in a vertical part of the well. The commingled fluids either flow or are artificially lifted from the vertical part of the well by equipment located substantially above the uppermost drainhole and productive formation(s). With this wellbore configuration, zone isolation, flow control, pump efficiency, and bottomhole pressure optimization is compromised. In some cases, downhole pumps are actually placed in the horizontal sections of the wells which partially remedies some of these problems, but typically leads to increased mechanical problems. When zone and/or drainhole isolation and flow control means are not incorporated in the well design, the entire well's production may be jeopardized if a production problem such as early water breakthrough occurs in one of the vertical well or drainhole completions.

In recent years, several more sophisticated multi-lateral drilling and completion techniques have been developed in an attempt to solve a host of difficult problems. It is well documented that the ideal multi-lateral system would overcome the shortcomings of the prior art and provide the following benefits: (1) infrastructure related to a cased vertical well should be used to efficiently deplete all economically productive zones with a series of vertical well completions and horizontal drainhole completions, (2) existing vertical wellbores with large diameter production casing should be re-enterable as the parent well for subsequent multi-lateral drilling and completion, (3) relatively simple design execution should be both cost effective and mechanically reliable, (4) should be applicable to short radius (ie: 60' turning radius) as well as medium radius (ie: 300' turning radius) drainholes used in high temperature enhanced oil recovery operations, (5) should not involve milling of "hard-to-drill" steel tubular goods to exit the cased vertical well for drainhole extension, (6) curve sections should be isolated from the horizontal target sections in drainholes to avoid hole collapse problems and/or premature gas or steam breakthrough, (7) light weight and flexible zone isolation and/or sand control liners should be installed in the horizontal target intervals of drainholes as well conditions dictate, (8) the size of the liner within each drainhole should be approximately equal to the final size of the production casing or liner string within the parent vertical wellbore, (9) the junction between the cased vertical well and each cased lateral well should be effectively sealed, (10) each vertical and/or horizontal well completion should be isolated within the vertical wellbore, (11) openable flow control devices should be employed to enable each completion to be selectively tested, stimulated, produced, or shut-in, (12) each drainhole should be accessible for re-entry to facilitate additional completion work, drilling deeper, drainhole interval testing with zone isolation, sand control, cleanout, stimulation, and/or other remedial work, and (13) the inside diameter of the final production casing or liner string in the vertical wellbore should be large enough to enable a downhole pump may be placed in a sump located below all productive horizons to optimize pressure drawdown during production operations and increase artificial lift efficiency. To date, a prior art multi-lateral drilling and completion system has not been developed that delivers all of the benefits described above.

U.S. patents of general interest in the field of horizontal well drilling and completion include: 2,397,070; 2,452,920; 2,858,107; 3,330,349; 3,887,021; 3,908,759; 4,396,075; 4,402,551; 4,415,205; 4,444,276; 4,573,541; 4,714,117; 4,742,871; 4,800,966; 4,807,704; 4,869,323; 4,880,059; 4,915,172; 4,928,763; 4,949,788; 5,040,601; 5,113,938; 5,289,876; 5,301,760; 5,311,936; 5,318,121; 5,318,122; 5,322,127; 5,325,924; 5,330,007; 5,337,808; 5,353,876; 5,375,661; 5,388,648; 5,398,754; 5,411,082; 5,423,387; and 5,427,177.

Of particular interest to this application is U.S. Pat. No. 5,301,760. According to this patent, a vertical well is drilled through one or more horizontal well target formations. The borehole may be enlarged adjacent to each proposed "kick-off point" prior to running and cementing production casing. An orientable retrievable whipstock/packer assembly (WPA) is used to initiate milling a window through a "more drillable" joint in the vertical well casing string in the direction of the proposed horizontal well target. A horizontal drainhole is then drilled as an extension of the vertical well. The drainhole is then completed with a cemented liner extending at least through the curve portion of the drainhole and into the vertical well. The protruding portion of the liner and cement in the vertical well is then removed using a full gauge (fitted to the vertical well casing inside diameter) burning shoe/fishing tool assembly. The resulting drainhole entrance point has an elliptical configuration with a sharp apex at the top of the liner and at the bottom of the liner at the junction of the lateral well with the vertical well due to the high angle (almost vertical) of the drainhole liner as it meets the vertical well. Furthermore, the "smooth" junction of the vertical well casing and the drainhole liner is effectively sealed by a highly resilient, impermeable cement sheath completely filling the annulus of the drainhole and the liner at the junction. Subsequent to "coring" through and removing the protruding portion of drainhole liner and cement in the vertical well, the WPA is removed from the well, thus re-establishing the full gauge integrity of the vertical well to enable large diameter downhole tools to be lowered below the drainhole entrance point. Additional drainholes may be drilled as extensions from the vertical parent well in a similar fashion.

Another U.S. patent of particular interest to this application is U.S. Pat. No. 5,289,876. According to this patent, one or more drainholes are drilled and completed using a method such as that described in U.S. Pat. No. 5,301,760 in junction with a novel method for preventing drainhole collapse, isolating lateral intervals drilled out-of-the-target zone, and providing sand control for laterals drilled through unconsolidated sands or incompetent formations. A light weight, flexible, "drillable" liner assembly is used to facilitate gravel packing with high temperature resistant curable resin coated sand. Subsequent to pumping the gravel pack, the "drillable" drainhole liner together with a veneer of cured resin coated sand adjacent to the target horizon is removed using a coil tubing conveyed mud motor and pilot mill. A liner with an inside diameter slightly larger than the outside diameter of the pilot mill is placed adjacent to the lateral intervals drilled out-of-the-target zone to isolate these intervals. The method disclosed in this patent is applicable to short and medium radius horizontal wells used in high temperature enhanced oil recovery operations.

Multi-lateral wells drilled and completed using the method disclosed in U.S. Pat. No. 5,289,876 in conjunction with the techniques described in U.S. Pat. No. 5,301,760 provide nine of the thirteen beneficial attributes previously described for the ideal multi-lateral system, namely: (1), (2), (3), (4), (5), (6), (7), (9), and (13). A need presently exists for a reliable and cost effective drilling and completion system for multi-lateral wells that addresses all thirteen previously described benefits. Accordingly, it is an object of the present invention to enhance the utility of the methods disclosed in U.S. Pat. Nos. 5,289,876 and 5,301,760 by allowing: (a) each vertical and/or horizontal well completion to be isolated within the vertical wellbore, (b) openable flow control devices to be employed to enable each completion to be selectively tested, stimulated, produced, or shut-in, (c) each drainhole to be selectively accessible for re-entry to facilitate additional completion work, drilling deeper, drainhole interval testing with zone isolation, sand control, cleanout, stimulation, and other remedial work either before or after completion isolation and flow control means are installed, and (d) the size of the liner within each drainhole to be approximately equal to the final size of the production casing or liner string within the parent vertical wellbore.

SUMMARY OF THE INVENTION

To substantially alleviate the deficiencies of the prior art and to provide the benefits discussed hereinabove, the present invention is incorporated and broadly described herein in two embodiments related to multi-lateral wells. Prior to application of the inventive techniques and apparatus, the following drilling and completion steps have been performed in accordance with the methods disclosed in U.S. Pat. No. 5,301,760: (1) configuring a new or pre-existing, substantially vertical, cased well (hereinafter sometimes referred to as primary well) penetrating one or multiple hydrocarbon bearing formations with one or more lateral wells (ie: upper and lower drainholes) drilled as extensions of the primary well with each lateral being equipped with a cemented liner through at least the curve portion of the lateral and into the cased primary well, (2) re-establishing the full bore integrity of the cased primary well after running and cementing the drainhole liner(s) such that the elliptical shaped junction between each drainhole and the primary well is sealed, and (3) perforating the casing in the primary well at a drainhole target horizon and/or adjacent to other potentially productive zones (ie: lowermost zone).

The first embodiment relates to providing re-entry means into a drainhole drilled and completed as an extension of a primary web before any completion isolation or flow control means are installed within the primary well. The inventive method and apparatus comprise the steps of: (1) running a work string conveyed retrievable whipstock/packer assembly (WPA) into the primary well to a depth corresponding with the approximate location of the drainhole to be re-entered and comprising an external casing packer (ECP) located at its lower end, a drillable locator ring above the ECP, a lower whipstock member with a built-in openable window gate device, an upper whipstock member with a diverter face, and a bore passing entirely through the WPA, (2) aligning the diverter face to the approximate azimuth direction of the longest center-line axis of the drainhole opening using gyroscopic orientation means, (3) using wireline conveyed logging means to open the WPA's window gate device and image the inner wall of the primary well, (4) moving the WPA and logging means simultaneously to locate the exact location of the lowermost apex of the elliptical shaped drainhole opening at the junction of the drainhole and primary well, (5) anchoring the WPA in the primary well casing and retrieving the setting tool, (6) installing a self-orienting "drillable" shaped plug in the bore of the WPA adjacent to the diverter face, (7) conducting said re-entry operation to facilitate additional completion work, drilling deeper, drainhole interval testing with zone isolation, sand control, cleanout, stimulation, and/or other remedial work, and (8) removing the WPA to re-establish the full bore integrity of the cased primary well.

The second embodiment is an inventive technique comprising the steps of: (1) running a lower production liner assembly (PLA) into the primary well using a work string and liner setting tool consisting of: (a) an external casing packer (ECP) located below a perforated casing completion, (b) an openable flow control valve (ie: port collar) with a sand control sleeve encasement (FCD) located adjacent to said perforations, (c) an ECP located above said perforations, but below a lower drainhole entrance point, (d) a precut window located adjacent to said lower drainhole entrance point, (e) an internal seal bore/latch down profile collar located slightly below said precut liner window with a built-in liner orientation guide slot indexed 180° opposed to the longest center-line axis of said precut liner window, (f) an internal seal bore profile collar located slightly above said liner window, (g) an ECP located above both said liner window and said profile collar, and (h) a flared liner seal bore receptacle connected to the work string conveyed liner setting tool with left-hand threads, (2) aligning the bottom of the precut liner window in said lower PLA with the exact bottom of the junction of the primary wellbore and the lower cemented drainhole liner in both depth and azimuth direction, (3) inflating the ECPs to permanently anchor the lower PLA within the cased primary well such that the precut liner window is in alignment with the lower drainhole entrance point to facilitate subsequent re-entry by engaging a preconfigured guide key extending from a WPA into the orientation guide slot built into a internal seal bore/latch down profile collar located slightly below said precut liner window, (4) running an upper PLA into the primary well using a work string and liner setting tool consisting of: (a) seal assembly mandrel to sting into the seal bore at the top of the lower PLA to provide both vertical and rotational travel for said upper PLA during alignment step (5), (b) a precut window located adjacent to said upper drainhole entrance point, (c) an internal seal bore/latch down profile collar located slightly below said precut liner window with a built-in liner orientation guide slot indexed 180° opposed to the longest center-line axis of said precut liner window, (d) an internal seal bore profile collar located slightly above said liner window, (e) an ECP located above both said liner window and said profile collar, and (f) a flared liner seal bore receptacle connected to the work string conveyed liner setting tool with left-hand threads, (5) aligning the bottom of the precut liner window in said upper PLA with the exact bottom of the junction of the primary wellbore and the upper cemented drainhole liner in both depth and azimuth direction, (6) inflating the ECP to permanently anchor the upper PLA within the cased primary well such that the precut liner window is in alignment with the upper drainhole entrance point to facilitate subsequent re-entry by engaging a preconfigured guide key extending from a WPA into the orientation guide slot built into the internal seal bore/latch down profile collar, (7) installing retrievable, openable, FCD sleeves adjacent to each precut liner window using the seal bore/latch down profile collars located below each precut window liner to seal and latch the bottom of the FCDs and the seal bore profile collars located above each precut window to seal the top of the FCDs, (8) opening and closing the FCDs to facilitate selective stimulation, testing, production, injection, temporary shut-in, or permanent abandonment of each completion, (9) removing a retrievable FDC sleeve located adjacent to a drainhole desired to be re-entered, (10) aligning a retrievable WPA to the proper depth and azimuth direction to facilitate re-entry into said drainhole by engaging an orientation guide key apparatus built into a lower whipstock member at an azimuth 180° opposed to the whipstock face into the indexed orientation guide slot of the internal seal bore/latch down profile collar of the PLA, (11) anchoring said WPA in the primary well production liner and retrieving the setting tool, (12) conducting said re-entry operation to facilitate additional completion work, drilling deeper, drainhole interval testing with zone isolation, sand control, cleanout, stimulation, and/or other remedial work, (13) removing said retrievable WPA and re-installing said FCD sleeve, (14) operating FCDs to optimize production during the life cycle of the vertical parent well, and (15) installing an artificial lift system with a downhole pump located in the large diameter cased sump located below all producing horizons and/or drainholes to maximize pump efficiency and to enhance gravity drainage, thus improving the well's ultimate hydrocarbon recovery.

The aligning steps (i.e., steps (2) and (5)) of the inventive technique described in the second embodiment preferably involves a novel downhole video camera tool conveyed on electric wireline that has a focused projection indexed to the base of the precut liner window and is directed perpendicular to the longest center-line axis of said precut liner window to image the inner wall of the primary well casing as the video camera tool and PLA is slowly moved within the primary well casing to align said precut liner window with the opening made by the junction of the drainhole liner with the primary well casing.

Although the present invention is particularly suited to completions involving horizontal drainholes drilled as extensions from substantially vertical primary wells, those skilled in the art will recognize that the invention also has application in completion situations involving one or more wellbores which extend in directions other than horizontal and which are drilled as extensions from a primary well which is substantially horizontal or otherwise intentionally deviated, rather than vertical.

These and other objects, features, and advantages of this invention will become more fully apparent to those skilled in the art as this description proceeds, reference being made to the accompanying drawings and appended claims.

BRIEF DESCRIPTION OF THE DRAWINGS

The drawings incorporated herein serve to illustrate the principals and embodiments of this invention. Like elements illustrated in multiple figures are numbered consistently in each figure. Now referring to the drawings.

DETAILED DESCRIPTION OF THE PREFERRED EMBODIMENTS

Figure 1:
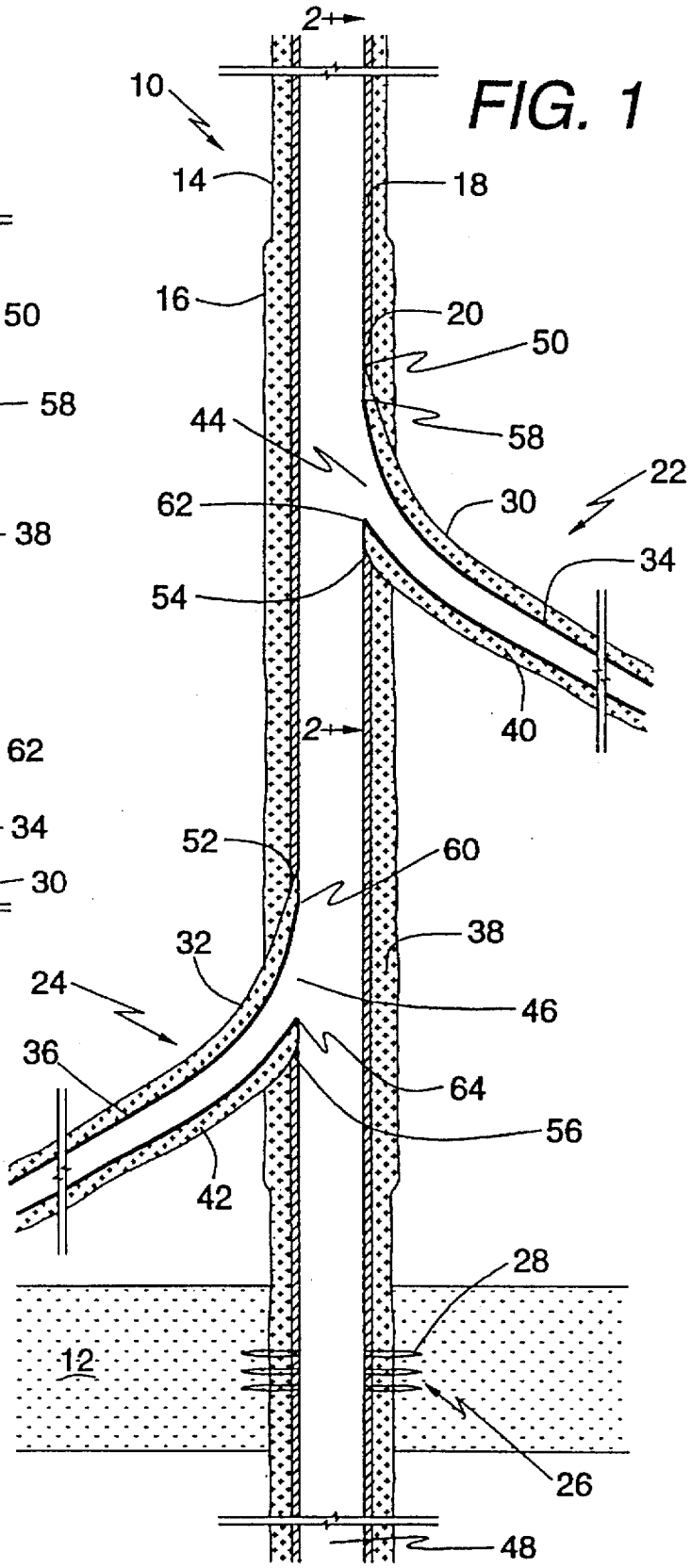
FIG. 1 is a cross-sectional elevational view of a multi-lateral well in an intermediate stage of completion which is suitably equipped and configured for subsequent implementation of this invention.

Referring to FIG. 1, a multi-lateral well 10, at a stage of completion prior to the application of the present invention, includes a substantially vertical borehole 14 drilled into the earth which penetrates a subterranean hydrocarbon bearing formation 12. Typically, the borehole 14 is logged or otherwise surveyed to provide reliable information about the top and bottom, porosity, fluid content, and other petrophysical properties of the formations encountered. A multi-lateral well plan is designed incorporating two horizontal drainhole completions 22, 24, together with one vertical well completion 26. Vertical wellbore 14 is enlarged to a larger borehole size 16 using an underreamer or other suitable drilling tool adjacent to each horizontal drainhole "kick-off point". A relatively large diameter (ie: 9⅝" O.D.) production casing string 18 is cemented in the borehole 14, 16 by an impermeable cement sheath 38 to prevent communication between hydrocarbon bearing formation 12 and other permeable formations penetrated by borehole 14, 16 in the annulus between the borehole 14, 16 and the casing string 18. Casing string 18 may include joints of casing 20 made of a more drillable material than steel (ie: carbon, glass, and epoxy composite material) positioned in the vertical portion of well 10 adjacent to each drainhole kickoff point to facilitate subsequent window cutting operations. Fibrous material or other cement additives may be included in the cement 38 to improve resiliency properties of the cement and make the cement less brittle.

As explained in applicant's U.S. Pat. No. 5,301,760 issued Apr. 12, 1994, entitled COMPLETING HORIZONTAL DRAIN HOLES FROM A VERTICAL WELL, a lower lateral borehole 32 has been drilled into the formation 12 using a retrievable whipstock/packer assembly (not shown) oriented and anchored within production casing 18 to initiate cutting an elliptically shaped window in the production casing with an apex 52 at the top and an apex 56 at the bottom. Subsequent to drilling at least the curve portion of the lower drainhole completion 24, a production liner string 36 is run at least partially in borehole 32 and cemented into place to provide a cement sheath 42 isolating the horizontal target section within formation 12 penetrated by borehole 32 from any overlying water bearing formations, incompetent formations, or non-target sections within formation 12 that may be prone to gas or steam coning. The upper end of the lower lateral liner string 36 and some cement initially extends into the vertical portion of well 10. This protruding portion of liner string 36 and cement within the vertical portion of well 10 is removed using a full gauge burning shoe/wash pipe/fishing tool assembly (not shown) sized only slightly less than the inside diameter of production casing string 18, to leave a relatively smooth entry opening at the junction of the lower lateral completion 24 and the vertical portion of well 10. The resulting lower drainhole opening or liner window 46 has an elliptical shape with an apex 60 at the top and an apex 64 at the bottom of the window 46 due to the high angle of the lower lateral liner as it meets with the vertical portion of well 10 (schematic of FIG. 1 is not drawn to scale or in realistic proportion). The lower lateral liner string 36 located adjacent to window 46 preferably includes one or more joints of liner made of a more drillable material than steel (ie: carbon, glass, and epoxy composite material) to facilitate the removal of said protruding portion of liner extending into the vertical portion of well 10.

Using a drilling and completion method similar to that described for the lower drainhole completion 24, an upper drainhole completion 22 may be drilled and completed. The upper drainhole completion 22 is comprised of a lateral borehole 30, a lateral liner pipe string 34 located within borehole 30, a cement sheath 40 at least partially filling the annulus between borehole 30 and liner 34, an elliptically shaped drainhole opening or liner window 44 with an upper apex 58 and a lower apex 62, and an elliptically shaped production casing window with an upper apex 50 and a lower apex 54.

In addition to configuring upper lateral completion 22 and lower lateral completion 24 pursuant to the methods described hereinabove, a vertical well completion 26 is configured with perforation flow passages 28 through production casing string 18 and into hydrocarbon bearing formation 12, thus establishing communication between formation 12 and the interior of production casing 18. In certain situations involving unconsolidated formations, it may be necessary to hydraulically jet wash the perforation flow passages 28 to create a void space adjacent to each perforation and employ a "behind the pipe" sand control procedure (ie: curable resin coated gravel pack or plastic formation sand consolidation treatment) prior to finishing the completion of the multi-lateral well 10 using the present invention. It will be evident that the lateral completions and the vertical well completion may target the same hydrocarbon bearing formation 12 or different hydrocarbon bearing formations. In addition, the invention has application in situations involving only one drainhole completion as well as multiple lateral completions extending from the vertical portion of well 10. It will also be evident that more than one vertical completion may be configured from the vertical portion of well 10.

Figure 2:
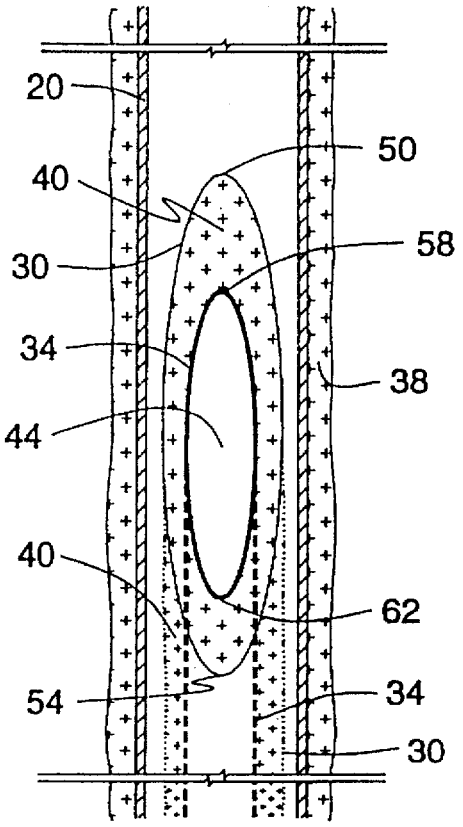
FIG. 2 is a cross-sectional side view of FIG. 1, taken substantially along line 2—2 thereof and taken prior to implementation of this invention.

Turning now to FIG. 2, a cross-sectional side view of FIG. 1, taken substantially along line 2—2 thereof and taken prior to implementation of this invention, shows the elliptical configuration of the upper liner window 44 at the junction between the upper drainhole completion 22 and the vertical portion of well 10. The annulus between the liner window 44 defined by its upper apex 58 and its lower apex 62 and the elliptical shaped production casing window defined by its upper apex 50 and lower apex 54 has been effectively sealed with an impermeable cement sheath 40. To improve the effectiveness of this hydraulic seal, fibrous material or other cement additives may be included in the cement 40 to improve resiliency properties of the cement and make the cement less brittle. In addition, lateral liner 34 is preferably centralized within borehole 30 prior to placement of cement sheath 40 to ensure cement sheath 40 completely surrounds liner pipe string 34 adjacent to window 44. In addition to placing a plurality of centralizers (not shown) on liner pipe string 34 to support liner 34 off the bottom of the curved borehole 30, a plurality of reinforcing members comprised of a suitable material (ie: lengths of the same type wire as used in wire casing scratchers) may be attached to liner 34 near window 44 to further facilitate the competency of the cement sheath 40 to seal the junction between the upper lateral completion 22 and the vertical portion of well 10.

Figure 3:
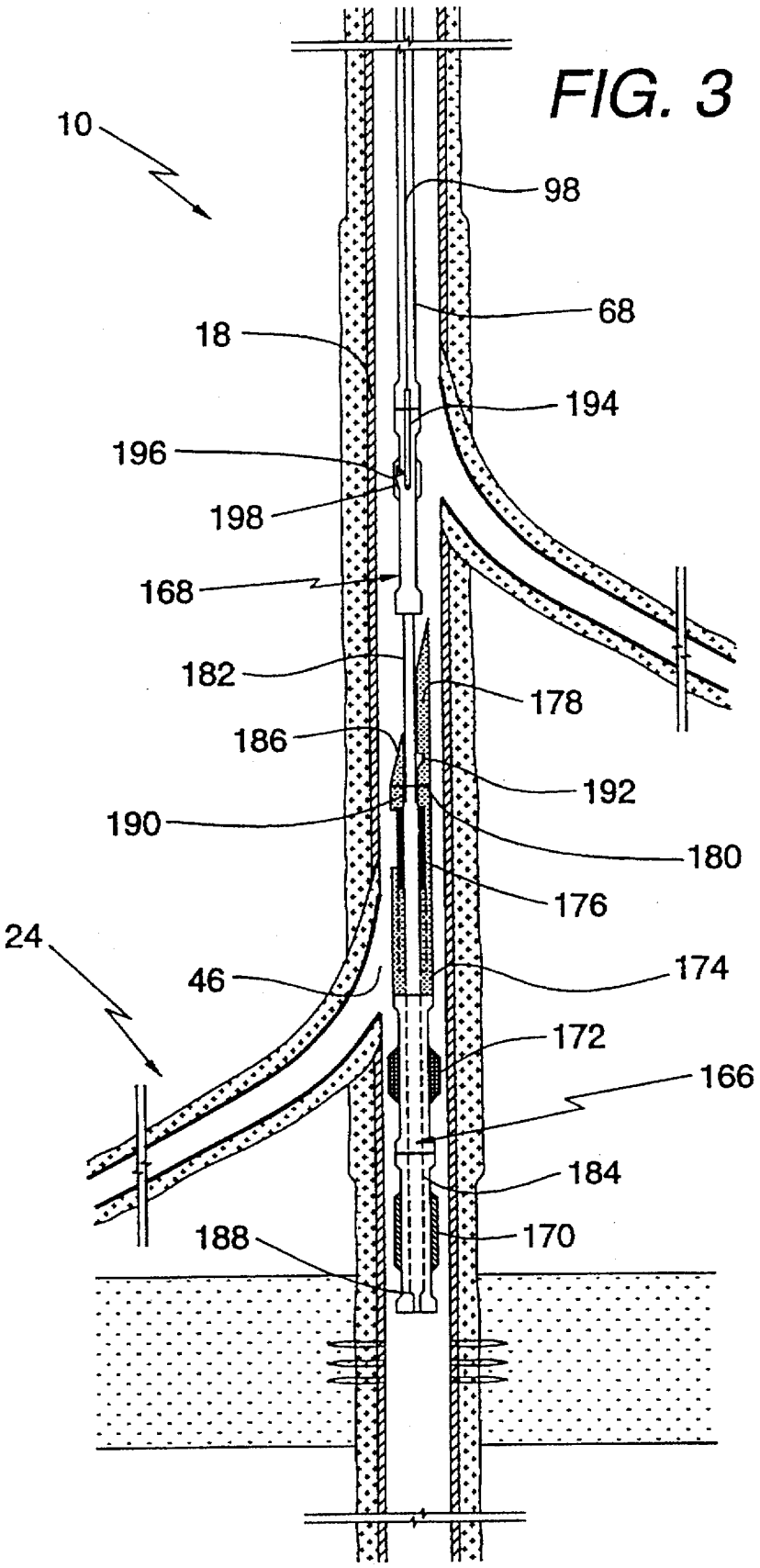
FIGS. 3–9 are cross-sectional elevational views depicting subsequent stages of the first embodiment relating to re-entering a drainhole extending from a multi-lateral well using a novel whipstock/packer assembly and routine work-over means.

Referring to FIG. 3, a disclosure of the first embodiment begins wherein a whipstock/packer assembly 166 is run into the vertical portion of well 10 using work string 68 and setting tool assembly 168. Whipstock/packer assembly 166 comprises an external casing packer 170 at its lower end for anchoring the whipstock/packer assembly 166 after proper alignment, a spacer sub with a "drillable" locator ring 172, a lower whipstock member 174 with a mechanically activated sliding window gate device 176, and a wedge shaped upper whipstock member 178 which is connected to lower whipstock member 174 by short hinge pins 180 to enable upper member 178 to pivot against lower member 174 in a direction opposite lower lateral completion 24 after packer 170 has been set and setting mandrel 182 has been removed. Whipstock/packer assembly 166 has a bore 184 extending from the whipstock face 186 to the end of the assembly at packer 170. Bore 184 has a smaller inside diameter seal profile 188 at the end of packer 170 to seat a weighted packer setting ball (not shown) after it has traveled through work string 68, setting mandrel 182, and whipstock/packer assembly 166. Subsequent to aligning whipstock/packer assembly 166 to facilitate re-entry into lateral completion 24, a packer setting ball (not shown) is dropped and seated in seal bore profile 188, then pressure is applied to hydraulically inflate anchoring packer 170 against the inside wall of casing string 18. Setting tool mandrel 182 extends through bore 184 in upper whipstock member 178 and into the top of lower member 174 and is connected to lower whipstock member 174 with left hand threads 190 to facilitate a clockwise rotational release after packer 170 is set. Upper whipstock member 178 has a orientation guide slot 192 extending from bore 184 into the inside wall of member 178 to facilitate setting a "drillable" shaped whipstock plug (not shown) to at least partially cover the opening in whipstock face 186 at the uppermost end of bore 184 after setting tool mandrel 182 is removed from whipstock/packer assembly 166.

Subsequent to running whipstock/packer assembly 166 into the vertical part of well 10 to a depth sufficient to position whipstock face 186 approximately adjacent to lateral liner window 46, a mechanically activated orientation guide key 196 built into a gyroscopic orientation device 194 conveyed on electric line cable 98 is engaged in an orientation key slot 198 built into setting tool assembly 168. Key slot 198 is indexed to whipstock face 186 prior to running whipstock/packer assembly 166 into well 10. Whipstock face 186 is then oriented in the approximate azimuth direction of the longest center-line axis of lateral liner window 46 by repetitive surveying with gyroscopic device 194 and incremental rotational movement of work string 68. Gyroscopic orientation device 194 is removed from well 10 after whipstock face 186 is positioned in approximate alignment with liner window 46.

Figure 4:
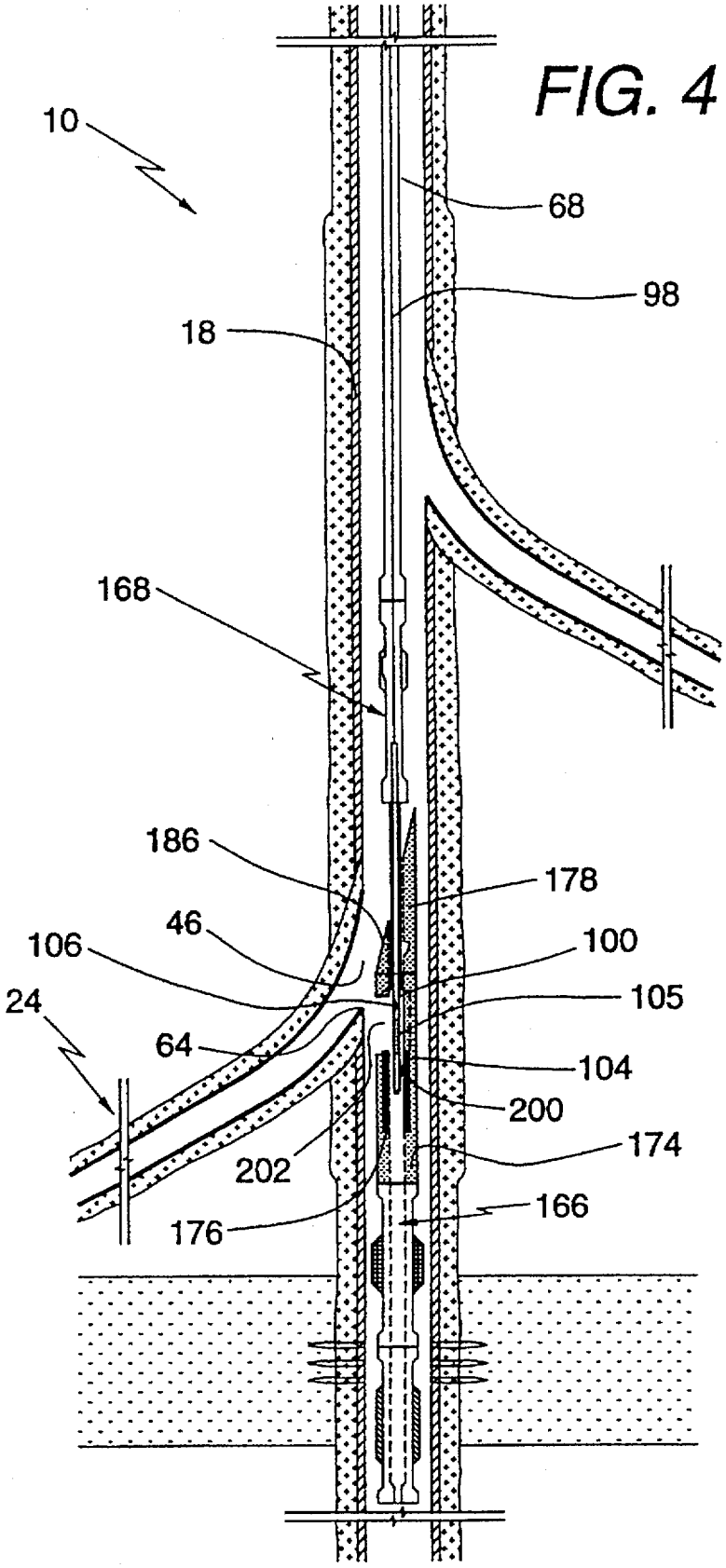

As shown in FIG. 4, gyroscopic orientation device 194 has been removed from well 10. An electric line 98 conveyed downhole video camera tool 100 with a mechanically activated orientation guide key 104 positioned at its lower end is run down through the work string 68, setting tool assembly 168, upper whipstock member 178, and into the top of lower whipstock member 174. Orientation guide key 104 is engaged into an orientation key slot 200 built into whipstock window gate device 176. Subsequent to latching the camera tool guide key 104 into sliding gate device 176, the focused projection camera lens 106 will be directed perpendicular to the longest center-line axis of lateral liner window 46 and in the same direction as the azimuth orientation of whipstock face 186. With camera tool 100 latched into gate device 176, gate device 176 is free to open with downward movement of the camera tool 100 and electric line 98. When gate device 176 is in maximum open position, whipstock window 202 is fully exposed and focused camera lens 106 is positioned directly adjacent to whipstock window 202 to enable camera tool 100 to image the inner wall of production casing string 18 near the lower lateral window 46. The video camera tool 100 with a focused light source 105 and the whipstock/packer assembly 166 is slowly moved together within the production casing string 18 by movement of work string 68 to locate the exact position of the lower apex 64 of the elliptically shaped lower lateral window 46. Camera tool 100 transmits real time video images of the downhole environment to a monitor at the surface (not shown) via electric line cable 98. Subsequent to surveying the wellbore environment around lateral window 46, the camera "target cross hairs" are aligned with lower apex 64, thus positioning whipstock face 186 in the exact location in both depth and azimuth direction to facilitate subsequent re-entry into lower drainhole completion 24. Whipstock window 202 is then sealed by closing sliding window gate device 176 with upward movement of camera tool 100 via electric line 98. Camera tool 100 is released from gate device 176 by shearing camera tool guide key 104 with further upward strain of electric line 98.

Figure 5:
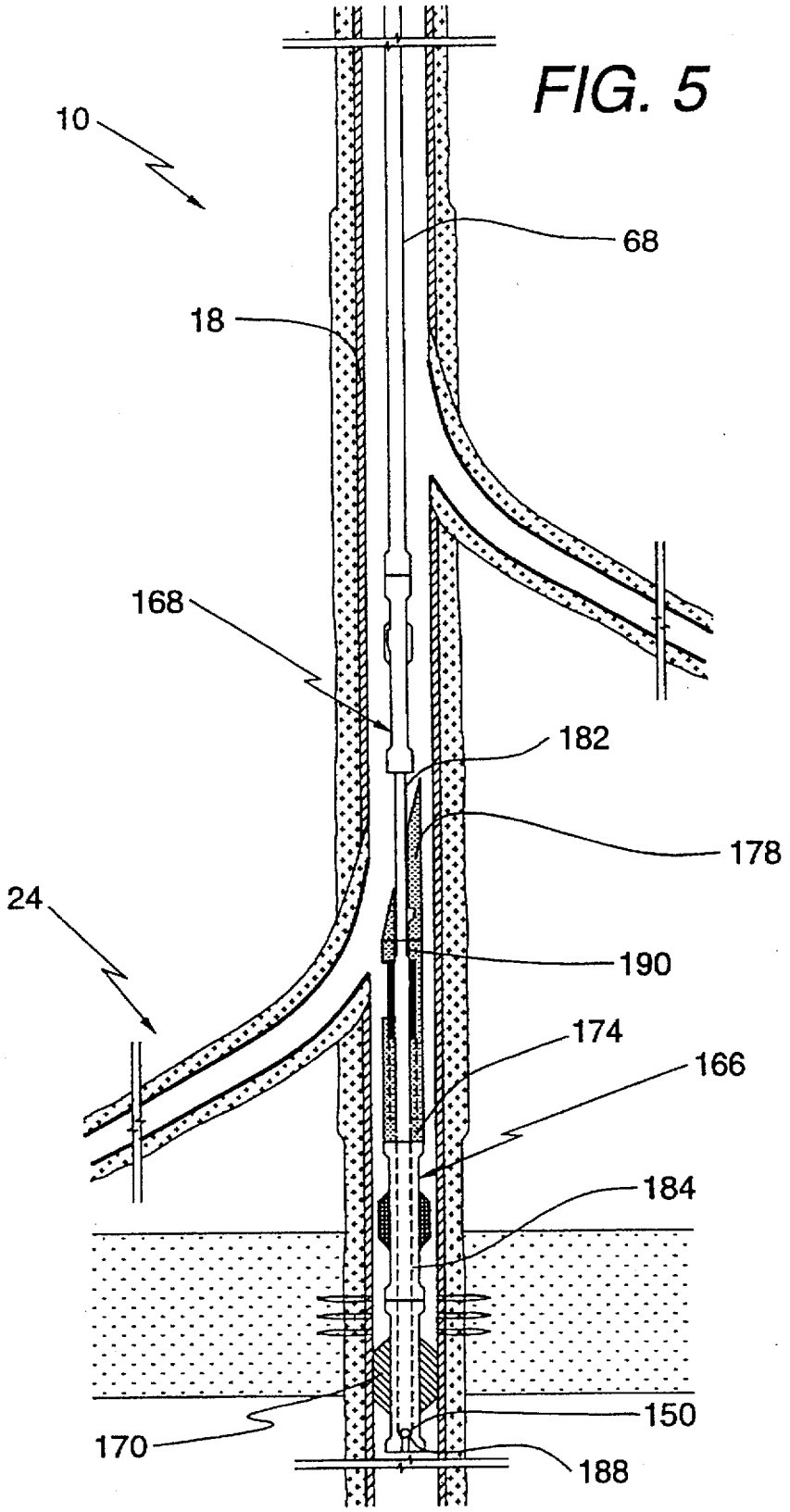

In FIG. 5, downhole video camera tool 100 has been removed from well 10 without moving work string 68 or whipstock/packer assembly 166. A weighted packer setting ball 150 is then dropped in work string 68 and is seated in seal bore profile 188. Pressure is applied from the surface through work string 68 and whipstock/packer assembly 166 against ball 150 to hydraulically inflate packer 170, thus anchoring whipstock/packer assembly 166 against casing string 18 in proper configuration to subsequent facilitate re-entry operations into lateral completion 24.

Figure 6:
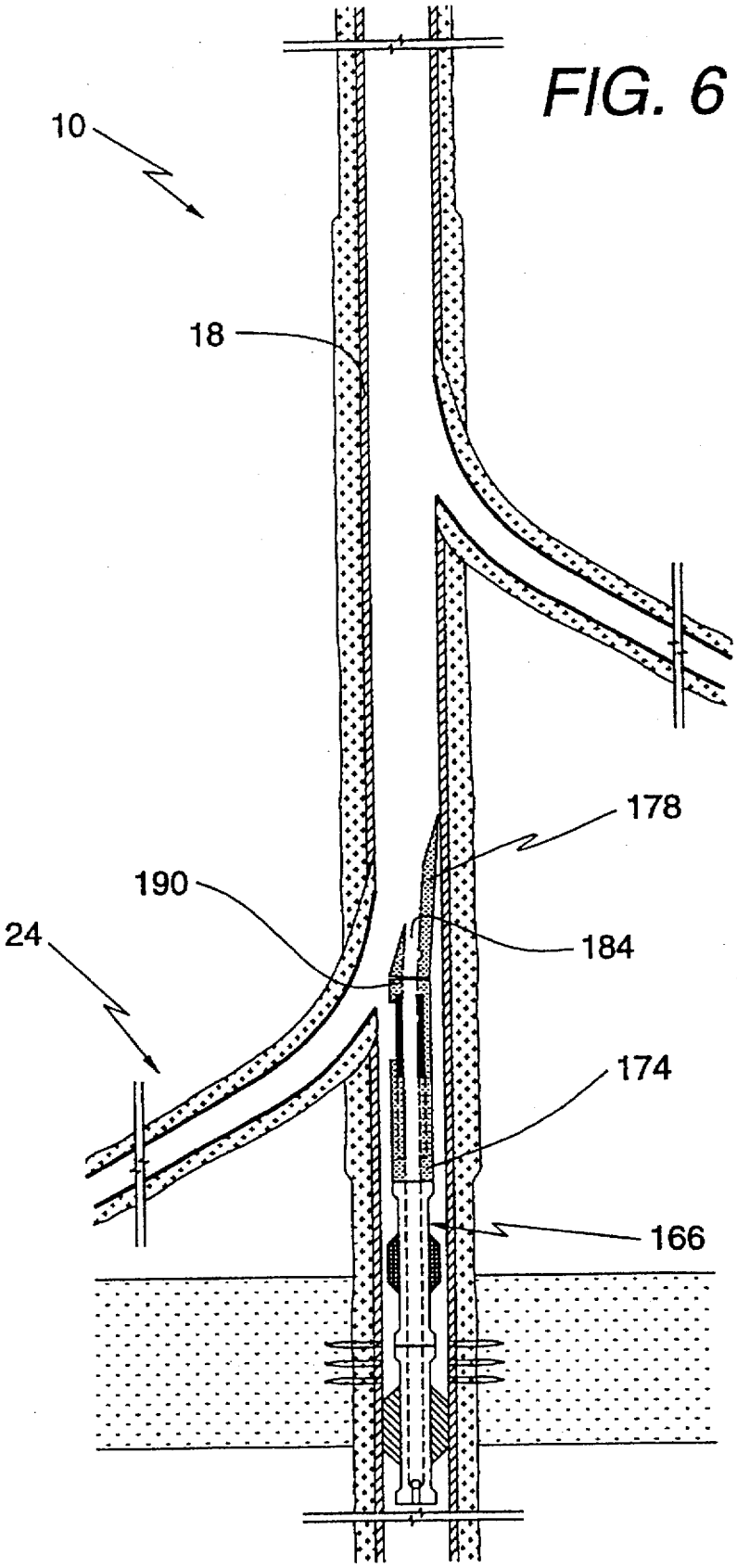

Turning now to FIG. 6, work string 68 and setting tool assembly 168 are rotated clockwise to release the diverter setting mandrel 182 (not shown) from whipstock/packer assembly 166 at left-hand threads 190. As the setting mandrel 182 is removed from bore 184, upper whipstock member 178 pivots against lower whipstock member 174 until top of upper member 178 rests on the inside wall of production casing string 18. The work string 68 and setting tool assembly 168 (not shown) are removed from well 10 to enable re-entry tools to be run through the vertical portion of well 10 and into lateral completion 24.

Figure 7:
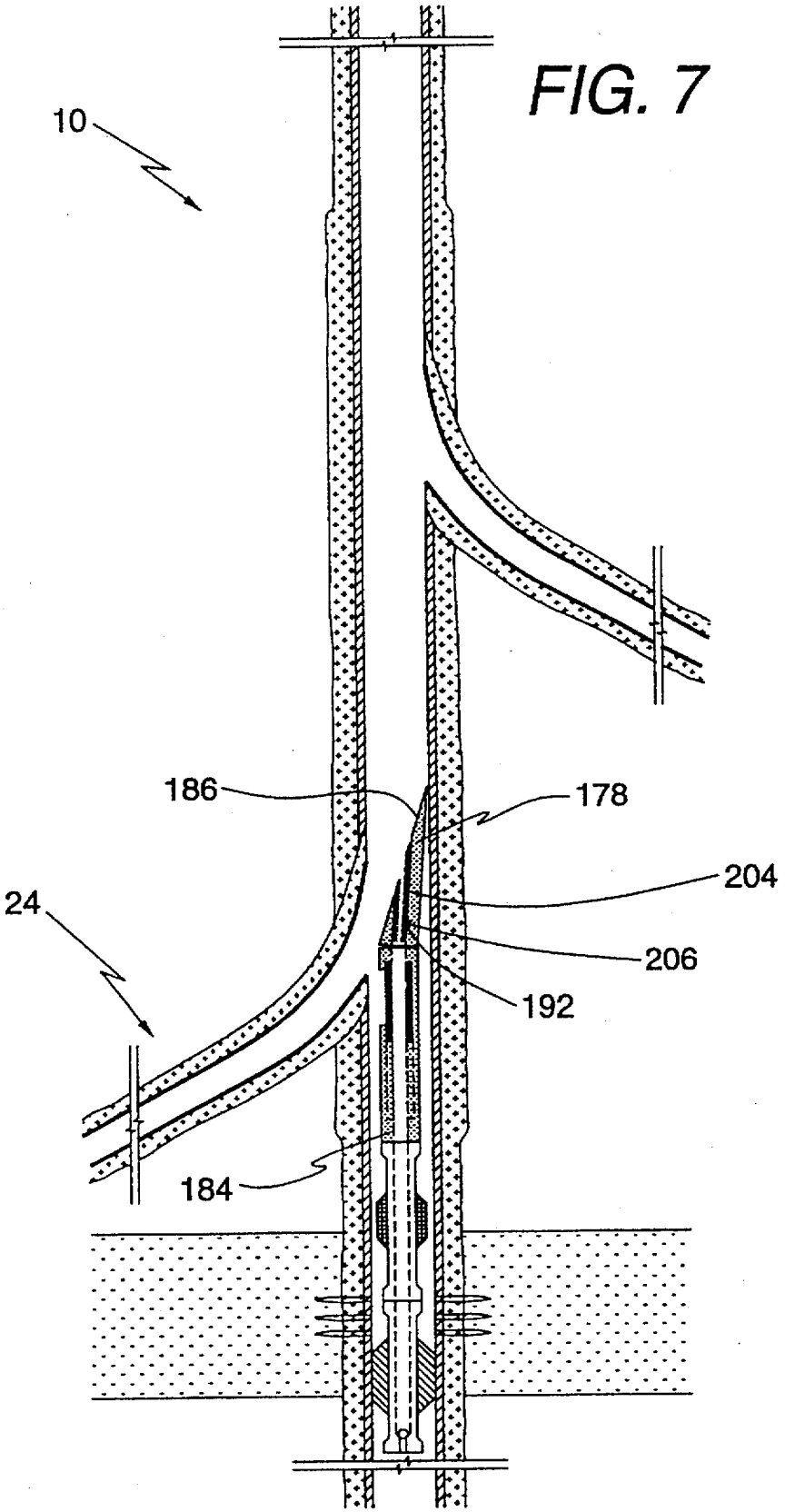

Referring to FIG. 7, a wireline conveyed "drillable" shaped whipstock plug 204 with a orientation guide key 206 has been installed in bore 184 of upper whipstock member 178. Plug 204 is automatically oriented within bore 184 using spiral path means (not shown) to the orientation guide key slot 192 built into bore 184 of upper whipstock member 178. Plug 204 is a wedge shaped device with a wedge configuration closely matching the wedge profile of whipstock face 186. Plug 204 is used to further facilitate the diversion of re-entry tools (not shown) from the vertical part of well 10 into lateral completion 24.

Figure 8:
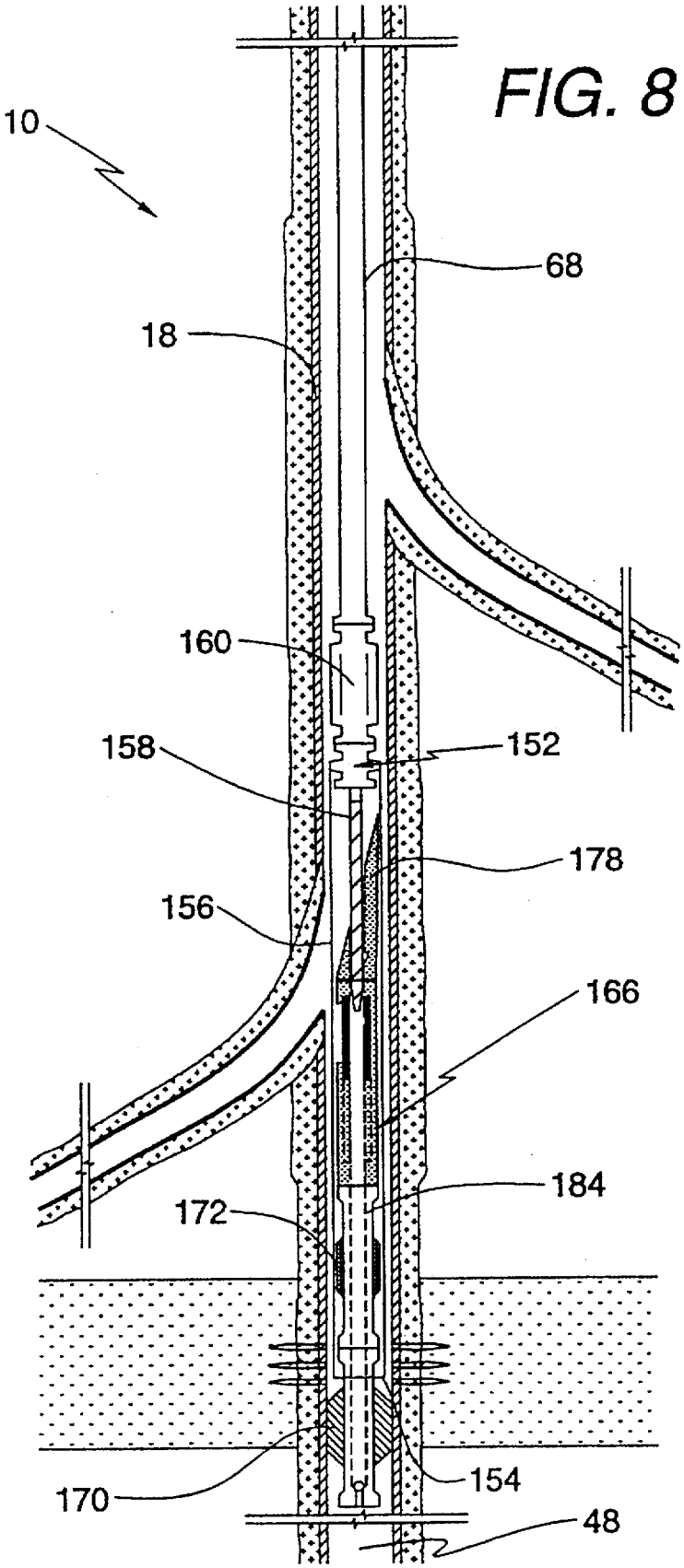

Referring now to FIG. 8, re-entry operations have been completed and whipstock/packer assembly 166 will be removed from well 10 in order to re-establish the large inside diameter integrity of the vertical portion of well 10 so large diameter tools may be placed in the cased sump 48 located below all completion intervals. A burning shoe/wash pipe/internal taper tap fishing tool assembly 152 is run on work string 68 to the top of whipstock/packer assembly 166. A mechanical or hydraulically activated jarring tool 160 is installed between work string 68 and fishing tool assembly 152 to provide means to impart a jarring action on whipstock/packer assembly 166 if necessary to facilitate removal of same. Fishing tool assembly 152 comprises a conventional full bore burning shoe 154 (ie: Type D Rotary Shoe which cuts on the bottom and on the inside of the shoe) at the bottom which is closely fitted to the inside diameter of production casing string 18, sufficient length of washpipe 156 to enable the upper portion of whipstock/packer assembly 166 (from the packer 170 to the top of upper whipstock member 178) to be swallowed as fishing tool assembly 152 is rotated and lowered over whipstock/packer assembly 166, and an internal taper tap tool 158 connected to the top of fishing tool assembly 152 and sufficiently spaced within washpipe 156 such that the bottom of taper tap tool will firmly engage bore 184 inside whipstock/packer assembly 166 as fishing tool assembly 152 rotates down to the top of packer 170. The locator ring on spacer sub 172 provides an indication to the driller that the burning shoe is immediately above the packoff elements of packer 170. After burning shoe 154 drills up a portion of locator ring on sub 172, taper tap tool 158 will torque up as it engages whipstock/packer assembly 166 through bore 184. The hole is then circulated to remove all debris released as a result of the burning shoe rotation. Shear pins (not shown) which deflate packer 170 are then broken by applying tensional force to work string 68, jars 160, and fishing tool assembly 152, thus releasing packer 170. Jarring tool 160 may be used to apply additional jarring force to shear deflation pin in packer 170 and otherwise free whipstock/packer assembly 166 from production casing string 18. Subsequent to removing whipstock/packer assembly 166, the configuration of multilateral well 10 has been re-established to a condition similar to the depiction of FIG. 1. The whipstock/packer assembly 166 may then be redressed or otherwise reconditioned for use in another re-entry operation.

Figure 9:
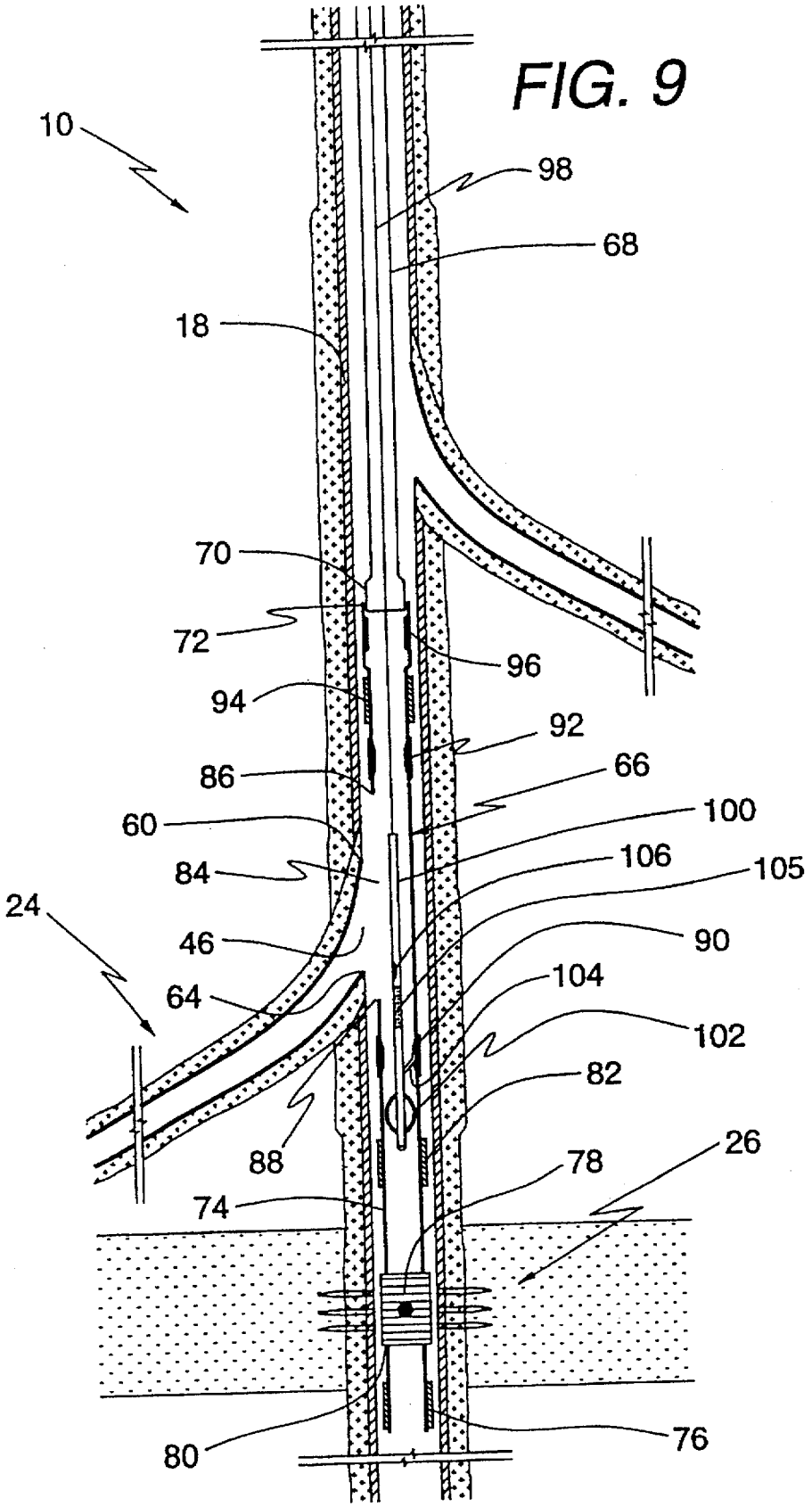
Figure 10:
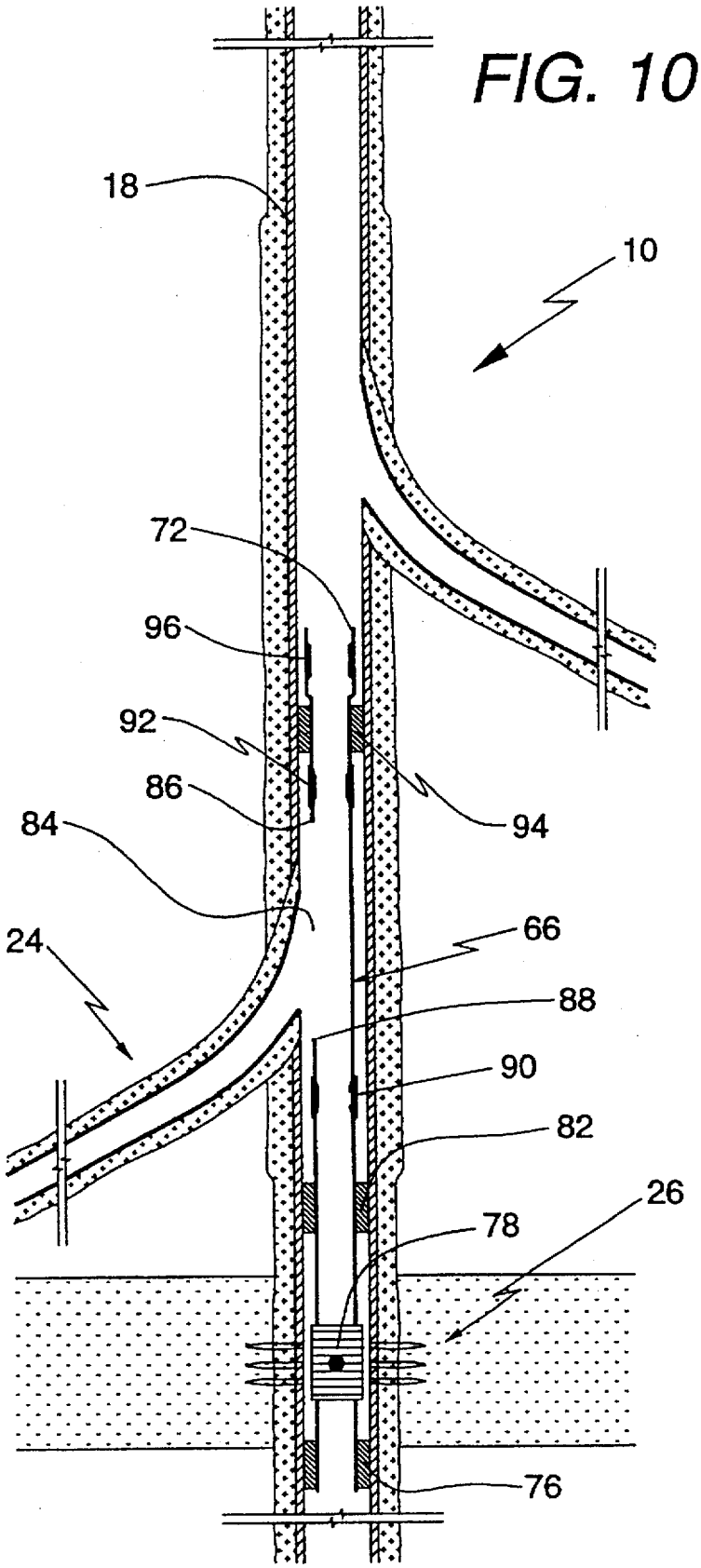
FIGS. 10–15 are sequential cross-sectional elevational views depicting the method of the second embodiment for completing a multi-lateral well using a novel production liner assembly to provide for completion isolation, selective flow control, and convenient drainhole re-entry access.

Referring to FIGS. 9 and 10, a disclosure of the second embodiment begins wherein a lower production liner assembly 66 is run into production casing string 18 located within the vertical portion of well 10 on the bottom of work string 68 connected to a liner setting tool 70 with left hand threads 72 to facilitate a clockwise rotational release. Lower liner assembly 66 comprises a central conduit or production liner 74 with an inside diameter substantially the same as the inside diameter of drainhole liner pipe string 34, 36, a hydraulically inflatable external casing packer 76 located below vertical well completion 26, an openable flow control device 78 (ie: mechanically or hydraulically activated port collar) with a sand control/filter sleeve encasement 80, a hydraulically inflatable external casing packer 82 located above vertical well completion 26, a precut production liner window 84 to be positioned adjacent to the lower lateral window 46 such that the upper extent 86 of liner window 84 is located above the upper apex 60 of lateral window 46 and the lower extend 88 of liner window 84 is located below the lower apex 64 of lateral window 46, an internal seal bore/latch down collar 90 located slightly below the base of precut liner window 84 with a liner orientation guide slot profile indexed exactly 180° opposed to the longest center-line axis of precut liner window 84, an internal seal bore collar 92 located slightly above the top of precut liner window 84, a hydraulically inflatable external casing packer 94 located above the lower lateral completion 24 and upper seal bore collar 92, and a flared liner seal bore receptacle 96 connected to the work string 68 and setting tool 70. Subsequent to running the lower production liner assembly 66 to the approximate depth so as to position the precut liner window 84 adjacent to the lower lateral window 46, an electric line 98 conveyed downhole video camera tool 100 with a centralizer 102 and an orientation guide key 104 positioned at its lower end is run down through the work string 68 and liner assembly 66. Subsequent to latching the camera tool guide key 104 into the liner orientation guide slot located in collar 90, the focused projection camera lens 106 will be directed perpendicular to the longest center-line axis of the precut liner window 84 in the same direction as the precut liner window 84 to image the inner wall of the production casing string 18 near the lower lateral window 46. The video camera tool 100 with a focused fight source 105 and the lower production liner assembly 66 is slowly moved within the production casing string 18 by movement of work string 68 to locate the exact position of the lower apex 64 of the elliptically shaped lower lateral window 46. Camera tool 100 transmits real time video images of the downhole environment to a monitor at the surface (not shown) via electric line cable 98. Subsequent to surveying the wellbore environment around lateral window 46, the camera "target cross hairs" are aligned with lower apex 64, thus positioning the precut liner window 84 in the exact location in both depth and azimuth direction to facilitate subsequent re-entry into lower drainhole completion 24. The downhole video camera tool 100 is then removed from well 10 without moving the work string 68 or lower production liner assembly 66. The three external casing packers 76, 82, 94 are then inflated preferably with nitrogen using a coil tubing conveyed isolation tool (not shown) to permanently anchor the lower production liner assembly 66 in proper alignment within well casing 18. Subsequent to setting packers 76, 82, 94, the work string 68 and setting tool 70 (not shown in FIG. 4) are rotated clockwise to release the setting tool from the lower liner assembly 66. The work string and setting tool are then removed from well 10 leaving the finer assembly 66 as shown in FIG. 10.

Figure 11:
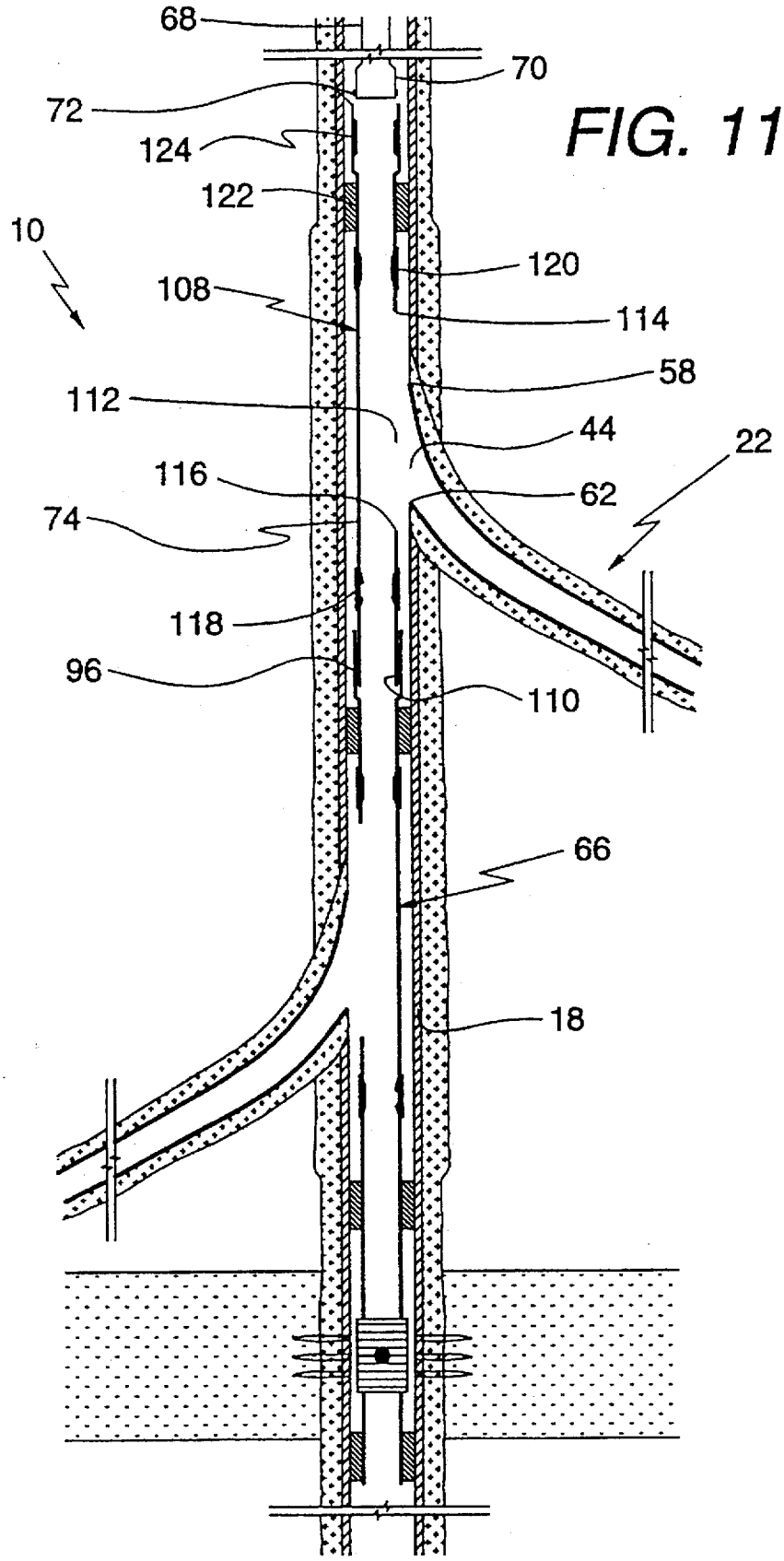

Referring now to FIG. 11, an upper production liner assembly 108 is run into the production casing string 18 located within the vertical portion of well 10 on the bottom of a work string 68 connected to a liner setting tool 70 with left hand threads 72 to facilitate a clockwise rotational release. Upper liner assembly 108 comprises a central conduit or production liner 74, a seal assembly mandrel 110 to sting into the flared seal bore receptacle 96 located at the upper end of the lower liner assembly 66 to provide both vertical and rotational travel for the upper liner assembly 108 during a subsequent upper liner assembly alignment step, a precut production liner window 112 to be positioned adjacent to the upper lateral window 44 such that the upper extent 114 of precut liner window 112 is located above the upper apex 58 of lateral window 44 and the lower extend 116 of precut liner window 112 is located below the lower apex 62 of lateral window 44, an internal seal bore/latch down collar 118 located slightly below the base of precut liner window 112 with a liner orientation guide slot profile indexed exactly 180° opposed to the longest center-line axis of precut liner window 112, an internal seal bore collar 120 located slightly above the top of precut liner window 112, a hydraulically inflatable external casing packer 122 located above the upper lateral completion 22 and upper seal bore collar 120, and a flared liner seal bore receptacle 124 connected to the work string 68 and setting tool 70. Subsequent to running the upper production liner assembly 108 into production well casing 18 and stinging seal assembly mandrel 110 into seal bore receptacle 96 so as to position the precut liner window 112 approximately adjacent to the upper lateral window 44, the same alignment and setting procedure used to align and set the lower production liner assembly 66 described hereinabove is used to align and set the upper production liner assembly 108. During the alignment step for the upper liner assembly 108, the seal assembly mandrel 110 should be of sufficient length to enable it to remain within the seal bore receptacle 96 to ensure the upper lateral completion 22 is effectively isolated from the lower lateral completion 24 after inflation of external casing packer 122. Subsequent to setting packer 122, the work string 68 and setting tool 70 are rotated clockwise to release the setting tool 70 from the upper liner assembly 108 at the left hand threads 72.

It will be appreciated that the relative positions of tools contained in the production liner assemblies 66, 108 may be adjusted to accommodate different well configurations, however it is anticipated that systems will be developed in order to standardize production liner assemblies to fit various "common" well geometry defined by production casing/lateral liner size and lateral well deviation angles at the junction between the vertical well and the lateral well.

Figure 12:
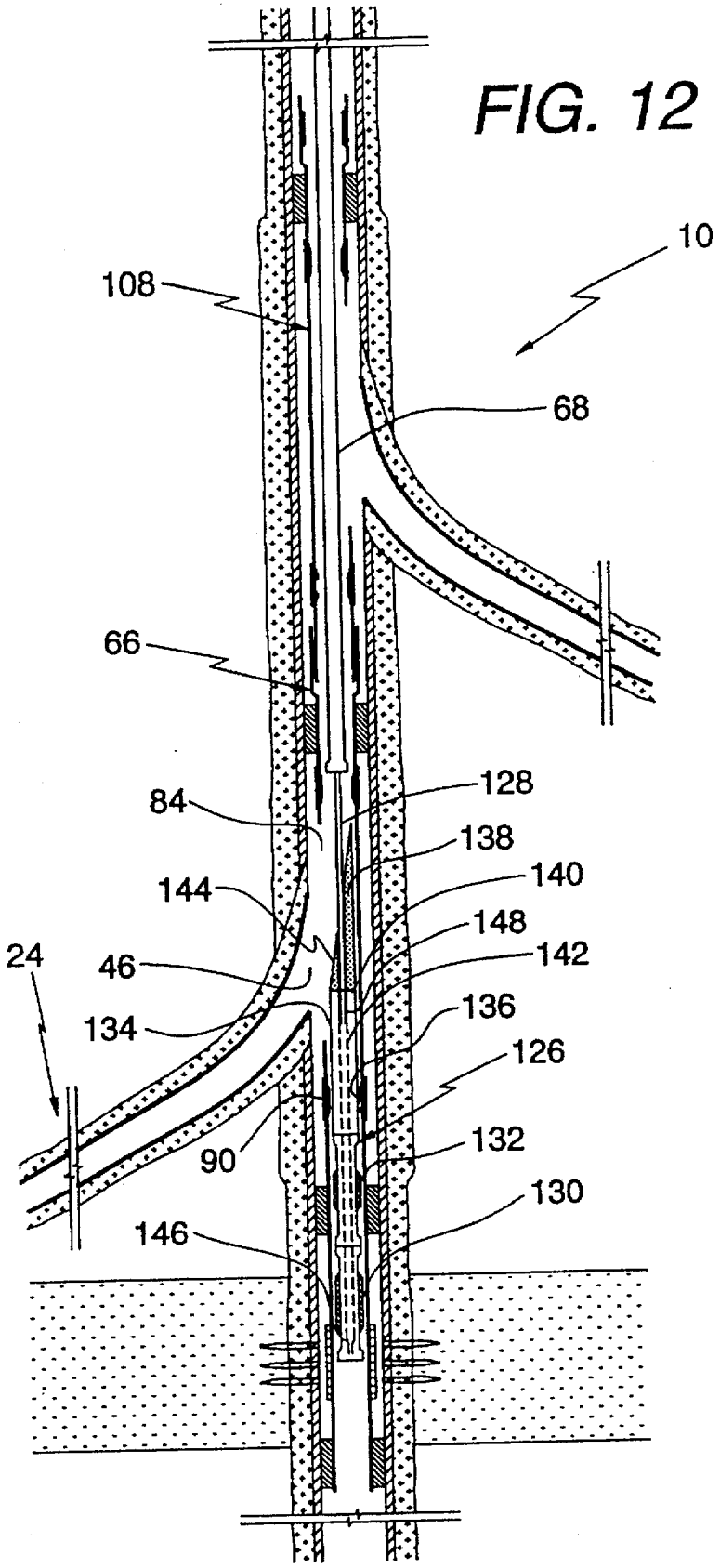

As illustrated in FIG. 12, the work string and setting tool (not shown) have been removed from well 10. Diverter assembly 126 is run into the vertical portion of well 10 and into upper production liner assembly 108 and lower production liner assembly 66 using work string 68 and divert assembly setting mandrel 128. Diverter assembly 126 comprises an external casing packer 130 at its lower end for anchoring the diverter assembly 126 after proper alignment, a spacer sub with a "drillable" locator ting 132, a lower whipstock member 134 with a spring activated orientation guide key 136, and a wedge shaped upper whipstock member 138 which is connected to lower whipstock member 134 by short hinge pins 140 to enable upper member 138 to pivot against lower member 134 in a direction opposite lower lateral completion 24 after packer 130 has been set and setting mandrel 128 has been removed. Diverter assembly 126 has a bore 142 extending from the whipstock face 144 to the end of the assembly at packer 130. Bore 142 has a smaller inside diameter seal profile 146 at the end of packer 130 to seat a weighted packer setting ball (not shown) after it has traveled through work string 68, setting mandrel 128, and diverter assembly 126. Subsequent to aligning diverter assembly 126 to facilitate re-entry of lateral completion 24, a packer setting ball (not shown) is dropped and seated in seal bore profile 146, then pressure is applied to hydraulically inflate anchoring packer 130. Diverter setting mandrel 128 extends through bore 142 in upper whipstock member 138 and into the top of lower member 134 and is connected to lower whipstock member 134 with left hand threads 148 to facilitate a clockwise rotational release after packer 130 is set. Diverter assembly 126 is positioned within lower production liner assembly 66 such that spring activated orientation guide key 136 engages liner orientation guide slot in seal bore/latch down profile collar 90 of the lower production liner assembly 66. With guide key 136 engaged in guide slot 90, whipstock face 144 will be aligned in both azimuth direction and depth to facilitate re-entry into lateral completion 24 through precut liner window 84 and lower lateral window 46 by diverting downhole tools (not shown) off whipstock face 144 and into lower lateral completion 24.

Figure 13:
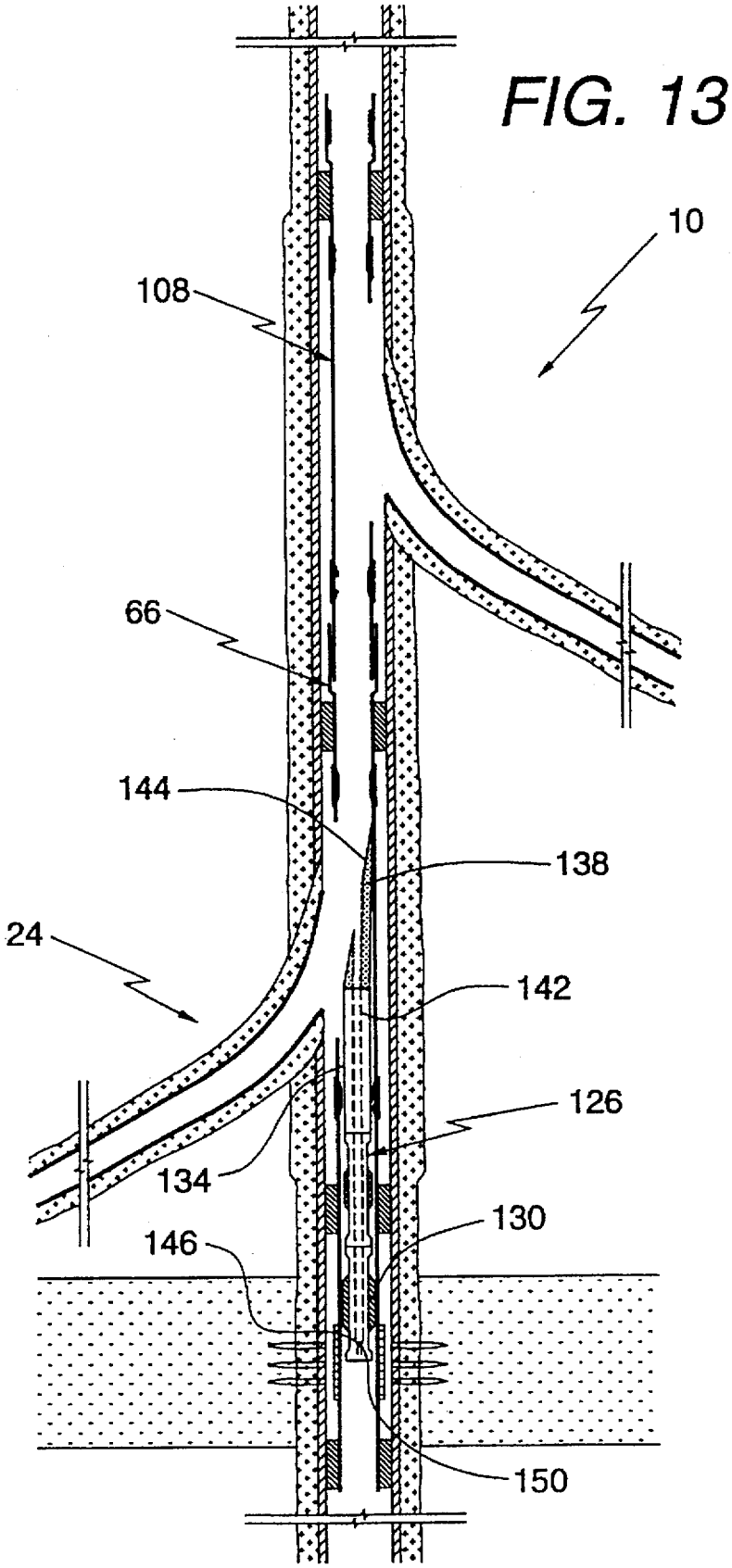

Referring to FIG. 13, weighted packer setting ball 150 is dropped through the work string (not shown) and seated in seal bore profile 146. Pressure is applied against ball 150 to hydraulically inflate packer 130. The work string is rotated clockwise to release the diverter setting mandrel (not shown) from the diverter assembly 126. As the setting mandrel is removed from bore 142, upper whipstock member 138 pivots against lower whipstock member 134 until top of upper member 138 rests on the inside wall of lower production liner assembly 66. The work string and setting mandrel are removed from well 10 to enable re-entry tools to be run through the vertical portion of well 10 and into lateral completion 24.

Figure 14:
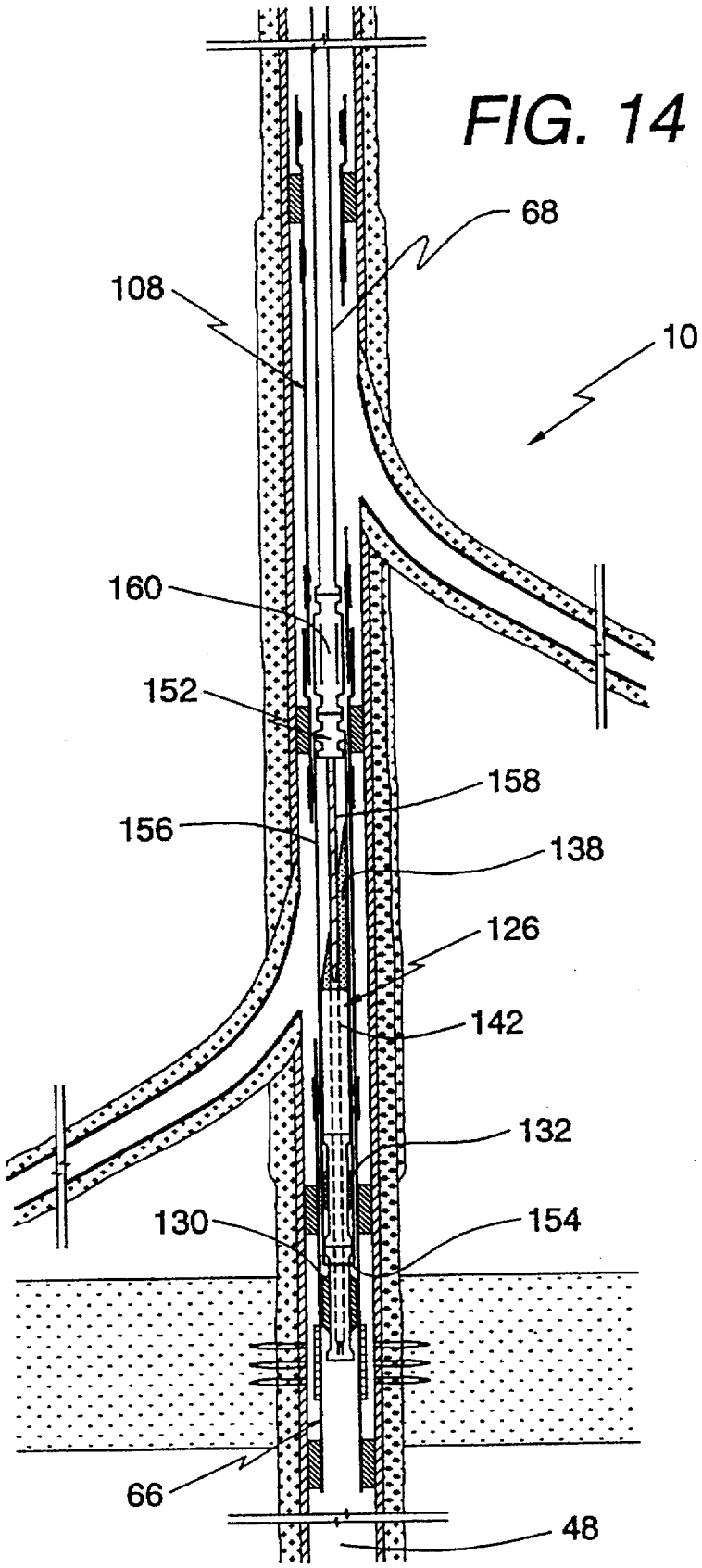

Referring now to FIG. 14, re-entry operations have been completed and diverter assembly 126 will be removed from well 10 in order to re-establish the large inside diameter integrity of the vertical portion of well 10 so large diameter tools may be placed in the cased sump 48 located below all completion intervals. A burning shoe/wash pipe/internal taper tap fishing tool assembly 152 is run on work string 68 to the top of diverter assembly 126. A mechanical or hydraulically activated jarring tool 160 is installed between work string 68 and fishing tool assembly 152 to provide means to impart a jarring action on diverter assembly 126 if necessary to facilitate removal of same. Fishing tool assembly 152 comprises a conventional full bore burning shoe 154 (ie: Type D Rotary Shoe which cuts on the bottom and on the inside of the shoe) at the bottom which is closely fitted to the inside diameter of the production liner assemblies 66, 108, sufficient length of washpipe 156 to enable the upper portion of diverter assembly 126 (from the packer 130 to the top of upper whipstock member 138) to be swallowed as fishing tool assembly 152 is rotated and lowered over diverter assembly 126, and an internal taper tap tool 158 connected to the top of fishing tool assembly 152 and sufficiently spaced within washpipe 156 such that the bottom of taper tap tool will fully engage bore 142 inside diverter assembly 126 as fishing tool assembly 152 rotates down to the top of packer 130. The locator ring on spacer sub 132 provides an indication to the driller that the burning shoe is immediately above the packoff elements of packer 130. After burning shoe 154 drills up a portion of the locator ring on sub 132, taper tap tool 158 will torque up as it engages diverter assembly 126 through bore 142. The hole is then circulated to remove all debris released as a result of the burning shoe rotation. Shear pins (not shown) which deflate packer 130 are then broken by applying tensional force to work string 68, jars 160, and fishing tool assembly 152, thus releasing packer 130. Jarring tool 160 may be used to apply additional jarring force to shear deflation pin in packer 130 and otherwise free diverter assembly from production liner assembly 66.

Figure 15:
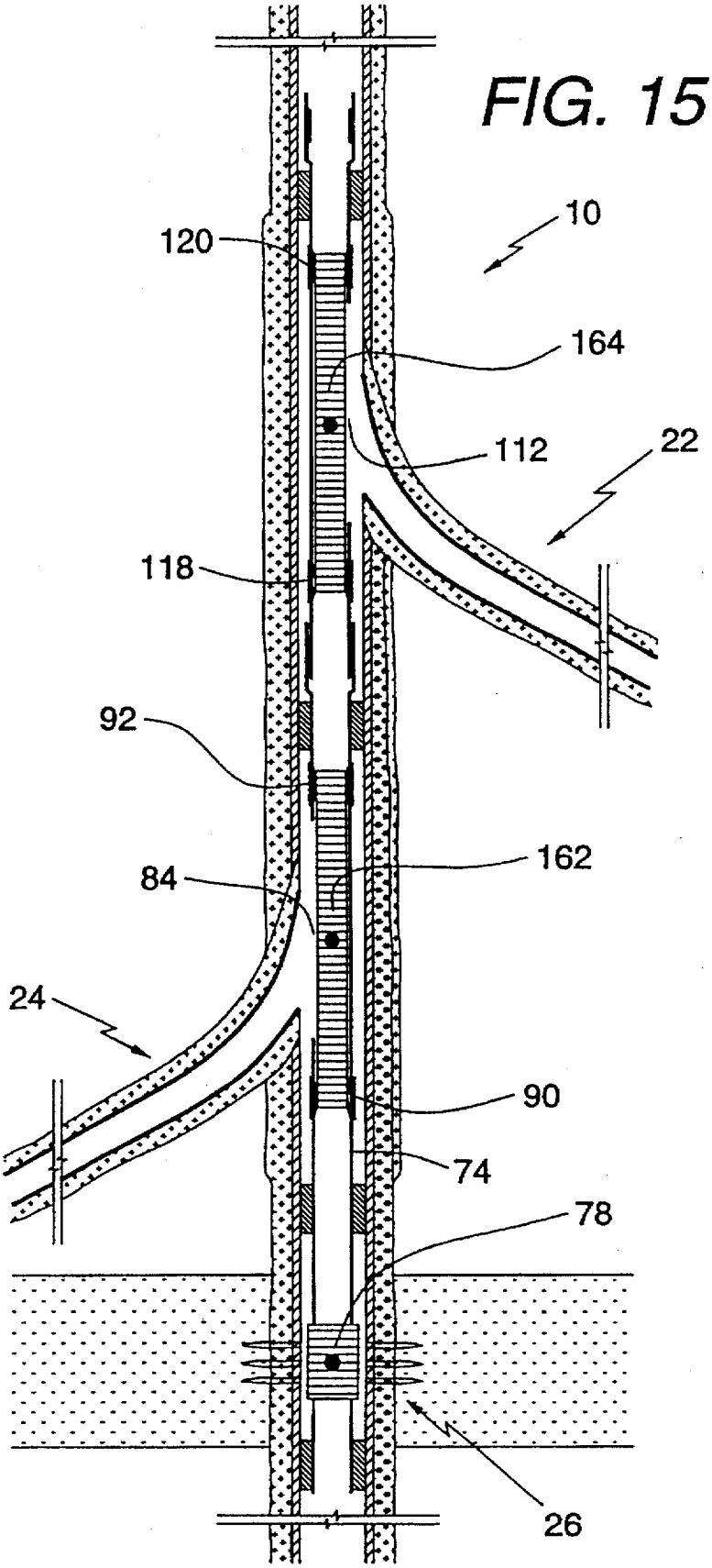

As shown in FIG. 15, the diverter assembly has been removed from the well by pulling the work string, jars, and fishing tool assembly out of the vertical portion of well 10. The diverter assembly may then be redressed or otherwise reconditioned for use in another re-entry operation.

A lower retrievable flow control device 162 with sand control encasement sleeve, lower seal/latch down mandrel, and upper seal mandrel is then conveyed on a work string with a clockwise rotation setting tool (not shown) to the lower precut liner window 84. The lower seal/latch down mandrel of the lower flow control device 162 is then latched and seated into internal seal bore/latch down profile collar 90. The upper seal mandrel in flow control device 162 will then be seated in internal seal bore collar 92 due to the preconfigured spacing of collar 92 relative to collar 90. The work string is then rotated clockwise to release flow control device 162 and removed from well 10.

An upper retrievable flow control device 164 with sand control encasement sleeve, lower seal/latch down mandrel, and upper seal mandrel is then conveyed on a work string with a clockwise rotation setting tool (not shown) to the upper precut liner window 112. The lower seal/latch down mandrel of the upper flow control device 164 is then latched and seated into internal seal bore/latch down profile collar 118. The upper seal mandrel in flow control device 164 will then be seated in internal seal bore collar 120 due to the preconfigured spacing of collar 120 relative to collar 118. The work string is then rotated clockwise to release flow control device 164 and removed from well 10.

A tool (not shown) to manipulate the flow control devices 78, 162, 164 is then run into the vertical portion of well 10 to facilitate selective testing, stimulation, production, or shut-in of the different isolated completions 22, 24, 26. The tool may be run on either production tubing, coil tubing, electric wireline, or non-electric wireline, depending on the type of flow control devices installed. As a result of relatively inexpensive workover operations, flow control devices 78, 162, 164 may be selectively opened and closed at any time during the productive life cycle of multi-lateral well 10. The completions 22, 24, 26 may be produced separately or commingled as conditions dictate due to the flow control means and completion isolation means disclosed herein. Should it become necessary to re-enter a lateral completion 22, 24 to facilitate additional completion work, drilling deeper, drainhole interval testing with zone isolation, sand control, cleanout, stimulation, and other remedial work, the appropriate retrievable flow control device 162, 164 is first removed using a taper tap or other suitable fishing tool (not shown) followed by the process described above to set and retrieve a preconfigured diverter assembly.

The multi-lateral completion system described herein provides a significant amount of flexibility related to hydrocarbon exploitation. For example (not shown), two tubing strings may be run into the vertical portion of well 10 with one string extending into production liner assembly 66, 108. A packer installed on the longer tubing string at a point below the precut upper liner window 112 would then seal the annulus between the tubing string and the production liner conduit 74. One or both of the lower completions 24, 26 could then be produced up the longer tubing string while the upper completion 22 is produced up the shorter tubing string contained entirely within vertical well casing 18.

In the alternative (not shown), a single production tubing string with a downhole pump provided at its lower end may extend through the inside of well casting 18 and production liner assembly 66, 108 to the large diameter cased sump 48 located below all completions 22, 24, 26. The downhole pump and its associated artificial lift equipment would then be used to artificially lift produced liquids as they gravity drain to the cased sump 48. Since most downhole pumps utilized in the oil industry today are designed to pump incompressible fluids only, pump efficiencies would be enhanced because any gas associated with the produced liquids would be free to vent out the annulus between the production tubing and production liner/casing as the liquids spill down to the pump. With the pump located below the producing horizons, reservoir pressure drawdown during production operations will be maximized yielding improved hydrocarbon recovery compared with downhole pumps located above the producing horizon(s) and/or above the lateral kick-off point(s). Since the downhole pump does not have to be positioned in a lateral wellbore to achieve maximum drawdown, mechanical risk is minimized and operating efficiency is enhanced.

It should be noted that the downhole video camera tool 100 used as a locating device to facilitate the alignment steps described hereinabove and illustrated in FIGS. 4, 9, and 11 could be replaced with any survey tool or probing device capable of directly or indirectly locating the lower apex 62, 64 of the generally elliptically shaped lateral window 44, 46 without deviating from the spirit of this invention.

Thus, the present invention is well adapted to overcome the shortcomings of the prior art, carry out the objects of the invention, and attain the benefits mentioned hereinabove as well as those inherent therein. Although this invention has been disclosed and described in its preferred forms with a certain degree of particularity, it is understood that the present disclosure of the preferred forms is only by way of example and that numerous changes in the details of construction and operation and in combination and arrangement of parts may be resorted to without departing from the spirit and scope of the invention as hereinafter claimed.

I claim:

1. A subterranean well system comprising:

a substantially vertical primary wellbore penetrating a hydrocarbon bearing formation;

a first deviated wellbore entering into the primary wellbore through a first opening and having a generally horizontal wellbore section extending into the formation;

a second deviated wellbore entering into the primary wellbore through a second opening located above the first opening and having a generally horizontal wellbore section extending into the formation in a direction different than the first deviated wellbore;

means establishing direct communication between the primary wellbore and the formation;

a lower production finer assembly in the primary wellbore comprising a conduit having a seal bore receptacle at its upper end, upper and lower packers straddling the first opening and isolating the first deviated wellbore, a precut liner window between the packers allowing re-entry into the first deviated wellbore, an indexed orientation profile device located in close proximity to the precut liner window facilitating alignment of the precut liner window with the first opening and subsequent re-entry into the first deviated wellbore, sealing profile devices located above and below the precut liner window allowing sealing means for subsequent installation of a retrievable openable flow control device adjacent to the precut liner window to selectively allow and prevent flow from the first deviated wellbore into the conduit, a third packer located below the direct communication means between the primary wellbore and the formation, and a second openable flow control device between the third packer and the lowermost packer straddling the first opening selectively allowing and preventing flow from the direct communication means into the conduit;

means to align the precut liner window in the lower production liner assembly with the first opening in the primary wellbore associated with the first deviated wellbore;

an upper production liner assembly in the primary wellbore comprising a conduit having a packer above the second opening and isolating the second deviated wellbore, a precut liner window below the packer allowing re-entry into the second deviated wellbore, an indexed orientation profile device located in close proximity to the precut liner window facilitating alignment of the precut liner window with the second opening and subsequent re-entry into the second deviated wellbore, sealing profile devices located above and below the precut liner window allowing sealing means for subsequent installation of a retrievable openable flow control device adjacent to the precut liner window to selectively allow and prevent flow from the second deviated wellbore into the conduit, and a seal mandrel located at the bottom of the upper production liner assembly for engagement into the lower production liner assembly; and means to align the precut liner window in the upper production liner assembly with the second opening in the primary wellbore associated with the second deviated wellbore.

2. The system of claim 1 wherein the substantially vertical primary wellbore may be substantially horizontal or otherwise intentionally deviated.

3. The system of claim 2 wherein the primary wellbore and the deviated wellbores extending from the primary wellbore are cased.

4. The system of claim 3 wherein the annulus formed between the casing strings and the wellbores are at least partially filled with an impermeable cement sheath.

5. The system of claim 4 wherein the junctions between each deviated wellbore and the primary wellbore are sealed, substantially elliptical in configuration, and generally conformable or flush with the inside of the primary wellbore casing.

6. The system of claim 4 wherein the direct communication means between the primary wellbore casing and the formation is through perforations in the primary wellbore casing.

7. The system of claim 1 wherein the indexed orientation profile devices are located in close proximity to the base of each precut liner window and comprise short pipe sections with orientation guide key slots indexed to the center-line axis of the precut liner windows facilitating alignment of the precut liner windows with the deviated wellbore openings and subsequent selective re-entry into the deviated wellbores.

8. The system of claim 7 wherein the indexed orientation profile devices further comprise short pipe sections with polished sealing profiles providing lower sealing means for subsequent installation of retrievable openable flow control devices adjacent to the precut liner window to selectively allow and prevent flow from the deviated wellbores into the conduit.

9. The system of claim 2 wherein the packers are external casing packers set hydraulically by inflation means.

10. The system of claim 2 wherein retrievable openable flow control devices having an outside diameter smaller than the inside diameter of the liner conduit are installed within the production liner assembly adjacent to one or more precut liner windows by seating the top and bottom of the retrievable openable flow control devices into the upper and lower sealing profile devices straddling the precut window liner to selectively allow and prevent flow from the deviated wellbore(s) into the conduit.

11. The system of claim 10 wherein the retrievable openable flow control devices comprise a conduit section having an internal axial flow passage and at least one traverse flow passage connecting the internal flow passage to the exterior of the conduit section, means selectively closing the transverse flow passage and a filter on the exterior of the conduit section preventing formation particles larger than a predetermined size from entering the transverse flow passage.

12. The system of claim 7 wherein the precut liner window alignment steps include using an imaging device to locate the base of the opening at the junction of the deviated wellbore and the primary wellbore by surveying the wall of the primary wellbore.

13. The system of claim 12 wherein the imaging device is a wireline conveyed downhole video camera tool comprised of:

an imaging lens focused and projected in a direction perpendicular to the longest centerline axis of the video camera tool;

a focused light source directed proximate to the imaging lens projection direction; and an orientation guide key indexed to the focused imaging lens projection.

14. The system of claim 13 wherein the inside wall of the primary wellbore is surveyed by first engaging the orientation guide key of the downhole video camera into the production liner assembly's indexed orientation profile device to automatically orient the focused camera projection toward the center-line axis of the precut liner window at a location proximate to the base of the precut liner window, then slowly moving the camera tool and production liner assembly within the primary wellbore as the camera tool provides surface video or imagery readout to enable proper alignment of the base of the precut liner window with the base of the deviated wellbore opening.

15. A method for selectively re-entering a deviated wellbore in a well having a first and second deviated wellbore drilled as extensions of a substantially vertical primary wellbore and comprising the steps of:

running a lower production liner assembly into the primary wellbore comprising a conduit having a seal bore receptacle at its upper end, upper and lower packers straddling the first opening and isolating the first deviated wellbore, a precut liner window between the packers allowing subsequent re-entry into the first deviated wellbore, an indexed orientation profile device located in close proximity to the precut liner window facilitating alignment of the precut liner window with the first opening and subsequent re-entry into the first deviated wellbore;

aligning the precut liner window in the lower production liner assembly with the first opening in the primary wellbore associated with the first deviated wellbore;

setting the packers in the lower production liner assembly and removing the liner setting tools from the primary wellbore;

running an upper production liner assembly into the primary wellbore comprising a conduit having a packer above the second opening and isolating the second deviated wellbore, a precut liner window below the packer allowing subsequent re-entry into the second deviated wellbore, an indexed orientation profile device located in close proximity to the precut liner window facilitating alignment of the precut liner window with the second opening and subsequent re-entry into the second deviated wellbore, and a seal mandrel located at the bottom of the upper production liner assembly for engagement into the lower production liner assembly;

aligning the precut liner window in the upper production liner assembly with the second opening in the primary wellbore associated with the second deviated wellbore;

setting the packer in the upper production liner assembly and removing the liner setting tools from the primary wellbore;

running diverter means into the primary wellbore and production liner assembly to the first opening at the junction between the primary wellbore and the first deviated wellbore wherein said diverter means is provided with a diverter face at its upper end, an orientation guide key below the diverter face, and anchor means at its lower end;

aligning diverter means so the center-line axis of diverter face is in alignment with the center-line axis of the lower liner precut window by engagement of the diverter's orientation guide key with the liner's indexed orientation profile device;

anchoring diverter means in production liner assembly and removing diverter setting tools;

directing an object from the primary wellbore, through part of the production liner assembly to the diverter means, and into the first deviated wellbore; and removing said diverter means to re-establish the full gauge integrity of the production liner assembly.

16. The method of claim 15 the substantially vertical primary wellbore may be substantially horizontal or otherwise intentionally deviated.

17. The method of claim 16 wherein the primary wellbore and the deviated wellbores extending from the primary wellbore are cased.

18. The method of claim 17 wherein the annulus formed between the casing strings and the wellbores are at least partially filled with an impermeable cement sheath.

19. The method of claim 18 wherein the junctions between each deviated wellbore and the primary wellbore are sealed, substantially elliptical in configuration, and generally conformable or flush with the inside of the primary wellbore casing.

20. The method of claim 15 wherein the indexed orientation profile devices are located in close proximity to the base of each precut liner window and comprise short pipe sections with orientation guide key slots indexed to the center-line axis of the precut liner windows facilitating alignment of the precut liner windows with the deviated wellbore openings and subsequent selective re-entry into the deviated wellbores.

21. The method of claim 16 wherein the packers are external casing packers set hydraulically by inflation means.

22. The method of claim 16 wherein the precut liner window alignment steps include using an imaging device to locate the base of the opening at the junction of the deviated wellbore and the primary wellbore by surveying the wall of the primary wellbore.

23. The method of claim 22 wherein the imaging device is a wireline conveyed downhole video camera tool comprised of:

an imaging lens focused and projected in a direction perpendicular to the longest centerline axis of the video camera tool;

a focused light source directed proximate to the imaging lens projection direction; and an orientation guide key indexed to the focused imaging lens projection.

24. The method of claim 23 wherein the inside wall of the primary wellbore is surveyed by first engaging the orientation guide key of the downhole video camera into the production liner assembly's indexed orientation profile device to automatically orient the focused camera projection toward the center-line axis of the precut liner window at a location proximate to the base of the precut liner window, then slowly moving the camera tool and production liner assembly within the primary wellbore as the camera tool provides surface video or imagery readout to enable proper alignment of the base of the precut liner window with the base of the deviated wellbore opening.

25. A method for selectively isolating multiple completions in a substantially vertical primary wellbore penetrating a hydrocarbon bearing formation including: (a) a first and a second deviated wellbore drilled as extensions of the primary wellbore into the formation wherein the inside diameter of primary wellbore at the junction or opening between the primary and the deviated wellbores are approximately equal to the inside diameter of the primary wellbore above or below the junction and (b) means to establish direct communication between the primary wellbore and the formation, and comprising the steps of:

running a lower production liner assembly into the primary wellbore comprising a conduit having an seal bore receptacle at its upper end, upper and lower packers straddling the first opening and isolating the first deviated wellbore, a precut liner window between the packers allowing re-entry into the first deviated wellbore, an indexed orientation profile device located in close proximity to the precut liner window facilitating alignment of the precut liner window with the first opening and subsequent re-entry into the first deviated wellbore, sealing profile devices located above and below the precut liner window allowing sealing means for subsequent installation of a retrievable openable flow control device adjacent to the precut liner window to selectively allow and prevent flow from the first deviated wellbore into the conduit, a third packer located below the direct communication means between the primary wellbore and the formation, and a second openable flow control device between the third packer and the lowermost packer straddling the first opening selectively allowing and preventing flow from the direct communication means into the conduit;

aligning the precut liner window in the lower production liner assembly with the first opening in the primary wellbore associated with the first deviated wellbore;

setting the packers in the lower production liner;

running an upper production liner assembly into the primary wellbore comprising a conduit having a packer above the second opening and isolating the second deviated wellbore, a precut liner window below the packer allowing subsequent re-entry into the second deviated wellbore, an indexed orientation profile device located in close proximity to the precut liner window facilitating alignment of the precut liner window with the second opening and subsequent re-entry into the second deviated wellbore, sealing profile devices located above and below the precut liner window allowing sealing means for subsequent installation of a retrievable openable flow control device adjacent to the precut liner window to selectively allow and prevent flow from the second deviated wellbore into the conduit, and a seal mandrel located at the bottom of the upper production liner assembly for engagement into the lower production liner assembly;

aligning the precut liner window in the upper production liner assembly with the second opening in the primary wellbore associated with the second deviated wellbore;

setting the packer in the upper production liner assembly;

installing and/or removing retrievable openable flow control devices adjacent to each precut liner window to selectively allow and prevent flow from the deviated wellbores into the conduit and to facilitate re-entry operations into one or both deviated wellbores; and using a flow control operating device to selectively open and close each openable flow control device contained within the production liner assembly of the primary wellbore to facilitate selective stimulation, testing, production, injection, temporary shut-in, or permanent completion abandonment.

26. The method of claim 25 wherein the substantially vertical primary wellbore may be substantially horizontal or otherwise intentionally deviated.

27. The method of claim 26 wherein the primary wellbore and the deviated wellbores extending from the primary wellbore are cased.

28. The method of claim 27 wherein the annulus formed between the casing strings and the wellbores are at least partially filled with an impermeable cement sheath.

29. The method of claim 28 wherein the junctions between each deviated wellbore and the primary wellbore are sealed, substantially elliptical in configuration, and generally conformable or flush with the inside of the primary wellbore casing.

30. The method of claim 28 wherein the direct communication means between the primary wellbore casing and the formation is through perforations in the primary wellbore casing.

31. The method of claim 25 wherein the indexed orientation profile devices are located in close proximity to the base of each precut liner window and comprise short pipe sections with orientation guide key slots indexed to the center-line axis of the precut liner windows facilitating alignment of the precut liner windows with the deviated wellbore openings and subsequent selective re-entry into the deviated wellbores.

32. The method of claim 31 wherein the indexed orientation profile devices further comprise short pipe sections with polished sealing profiles providing lower sealing means for subsequent installation of retrievable openable flow control devices adjacent to the precut liner window to selectively allow and prevent flow from the deviated wellbores into the conduit.

33. The method of claim 26 wherein the packers are external casing packers set hydraulically by inflation means.

34. The method of claim 26 wherein retrievable openable flow control devices having an outside diameter smaller than the inside diameter of the liner conduit are installed within the production liner assembly adjacent to one or more precut liner windows by seating the top and bottom of the retrievable openable flow control devices into the upper and lower sealing profile devices straddling the precut window liner to selectively allow and prevent flow from the deviated wellbore(s) into the conduit.

35. The method of claim 34 wherein the retrievable openable flow control devices comprise a conduit section having an internal axial flow passage and at least one traverse flow passage connecting the internal flow passage to the exterior of the conduit section, means selectively closing the transverse flow passage and a filter on the exterior of the conduit section preventing formation particles larger than a predetermined size from entering the transverse flow passage.

36. The method of claim 26 wherein the precut liner window alignment steps include using an imaging device to locate the base of the opening at the junction of the deviated wellbore and the primary wellbore by surveying the wall of the primary wellbore.

37. The method of claim 36 wherein the imaging device is a wireline conveyed downhole video camera tool comprised of:

an imaging lens focused and projected in a direction perpendicular to the longest centerline axis of the video camera tool;

a focused light source directed proximate to the imaging lens projection direction; and an orientation guide key indexed to the focused imaging lens projection.

38. The method of claim 37 wherein the inside wall of the primary wellbore is surveyed by first engaging the orientation guide key of the downhole video camera into the production liner assembly's indexed orientation profile device to automatically orient the focused camera projection toward the center-line axis of the precut liner window at a location proximate to the base of the precut liner window, then slowly moving the camera tool and production liner assembly within the primary wellbore as the camera tool provides surface video or imagery readout to enable proper alignment of the base of the precut liner window with the base of the deviated wellbore opening.

* * * * *